US010625511B2

(12) United States Patent
Marzano

(10) Patent No.: US 10,625,511 B2
(45) Date of Patent: Apr. 21, 2020

(54) COVER FOR A COMPACT INK RESERVOIR

(71) Applicant: Dover Europe Sàrl, Vernier (CH)

(72) Inventor: Thomas Marzano, Romans sure Isere (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 16/151,820

(22) Filed: Oct. 4, 2018

(65) Prior Publication Data

US 2019/0100022 A1 Apr. 4, 2019

(30) Foreign Application Priority Data

Oct. 4, 2017 (FR) ..... 17 59294

(51) Int. Cl.
*B41J 2/175* (2006.01)

(52) U.S. Cl.
CPC ..... *B41J 2/17553* (2013.01); *B41J 2/17503* (2013.01); *B41J 2/17513* (2013.01); *B41J 2/17523* (2013.01)

(58) Field of Classification Search
CPC .... B41J 2/175; B41J 2/17513; B41J 2/17523; B41J 2/17553
See application file for complete search history.

(56) References Cited

U.S. PATENT DOCUMENTS 6,422,691 B2 7/2002 Kobayashi et al.
6,712,458 B2 * 3/2004 Hatasa ..... B41J 2/17513 347/86
7,192,121 B2 3/2007 Barbet et al.
2002/0109761 A1 * 8/2002 Shimizu ..... B41J 2/17513 347/86
2003/0214565 A1 11/2003 Lee et al.
2004/0189755 A1 9/2004 Studholme
(Continued)

FOREIGN PATENT DOCUMENTS

EP 0783972 A1 7/1997
EP 0870618 A2 10/1998
(Continued)

OTHER PUBLICATIONS

Preliminary French Search Report for FR 1759294 dated May 24, 2018.
(Continued)

*Primary Examiner* — Anh T Vo
(74) *Attorney, Agent, or Firm* — Pearne & Gordon LLP

(57) ABSTRACT

A reservoir cover for a continuous inkjet printer with a surface called the upper surface (433$_1$), a surface called the lower surface (433$_2$), between which there is an upper part (433*a*) and a lower part (433*b*) of the cover, at least said lower part of the cover being delimited laterally by a peripheral surface ($S_e$), and: at least one through conduit (31) that passes through at least part of the cover to bring at least one liquid from said upper part to said lower part, at least one 1$^{st}$ liquid connection means (42, 42'), capable of being positioned removably relative to the upper surface (33$_1$) to bring at least one liquid to an inlet of said through conduit (31), that passes through the cover.

20 Claims, 15 Drawing Sheets

(56) References Cited

U.S. PATENT DOCUMENTS

| | | | |
|---|---|---|---|
| 2015/0273501 | A1 | 10/2015 | Naito et al. |
| 2017/0120613 | A1 | 5/2017 | Ikebe et al. |

FOREIGN PATENT DOCUMENTS

| | | | |
|---|---|---|---|
| EP | 2298123 | A1 | 3/2011 |
| EP | 3112172 | A1 | 1/2017 |
| EP | 3124254 | A2 | 2/2017 |
| FR | 3005459 | A1 | 11/2014 |
| WO | 2017036490 | A1 | 3/2017 |

OTHER PUBLICATIONS

U.S. Appl. No. 16/151,754, entitled "Compact Ink Reservoir", filed Oct. 4, 2018.
European Search Report for Application No. 18198586, dated Feb. 19, 2019.

* cited by examiner

COVER FOR A COMPACT INK RESERVOIR

CROSS-REFERENCE TO RELATED APPLICATIONS

This application claims priority from French Patent Application No. 17 59294 filed on Oct. 4, 2017. The content of this application is incorporated herein by reference in its entirety.

TECHNICAL DOMAIN AND PRIOR ART

The invention relates to the domain of industrial inkjet printers, for example continuous inkjet (CIJ) printers.

In particular, it also relates to a cover of a reservoir for such a printer.

Continuous ink jet (CIJ) printers are well known in the field of industrial coding and marking of various products, for example for high speed marking of barcodes, the expiration date on food products or references or distance marks on cables or pipes directly on the production line. This type of printer is also used in some decoration fields in which the possibilities of graphic printing of the technology are used.

FIG. 13 in application EP 3124254 shows an example of a supply circuit structure for such a printer that comprises 2 separate reservoirs, one for solvent and the other for ink.

FIG. 1 attached represents 2 such reservoirs 1, 2, one (reference 1) dedicated to solvent, the other (reference 2) dedicated to ink. The ink reservoir may have a cylindrical part 5 prolonged by a conical part 6. On this representation, it can be seen that the lateral volumes $V_3$, $V_4$ of the conical part 6, exterior to the conical part, are unused; similarly, the volumes $V_1$ and $V_2$, located above and below the reservoir 1 are also unused.

The result is non-optimum use of space in an industrial environment that is often constrained and restricted. The objective is to make a compact printing machine and the existing structure of the reservoir is not suitable for this purpose. The same problem arises if the structure of the reservoir 2 is cylindrical, encompassing the volumes $V_3$ and $V_4$.

Furthermore, this structure requires the fabrication of 2 covers 7, 8, each of which may comprise functions to receive liquid from the exterior (for example for filling the reservoir or to recover ink from a print head) and/or to send this liquid to the exterior (for example to supply the different parts of the circuit, particularly the print head). This introduces an extra cost.

Furthermore, a reservoir cover, particularly provided with functions to receive liquid from the exterior (for example for filling the reservoir or to recover ink from a print head) is expensive to fabricate and in general can only be used for a specific application, in a given environment (particularly for a given fluid circuit). Therefore another technical problem arises, namely to manufacture a reservoir cover, that can include one or several liquid reception function, but is adaptable to different configurations of the fluid circuit.

PRESENTATION OF THE INVENTION

The first object or purpose of the invention is a reservoir cover for a continuous inkjet printer with a surface called the upper surface, a surface called the lower surface, between which there is for example an upper part and a lower part of the cover, at least said lower part of the cover being delimited laterally by a peripheral surface ($S_e$), and:

- at least one through conduit that passes through at least part of the cover to bring at least one liquid from said upper surface or from said upper part to said lower surface or to said lower part,
- at least one $1^{st}$ liquid connection means, capable of being positioned removably relative to the upper surface of the cover, at different positions on this upper surface, said $1^{st}$ liquid connection means comprising at least one inner conduit to bring at least one liquid to an inlet of said through conduit, that passes through the cover or through at least part of the cover;
- means for maintaining said $1^{at}$ liquid connection means fixed relative to the cover, in one of said positions.

Said means for maintaining comprise for example at least one of a screw or a quarter turn fastener or one or more clamp collar or one or more clips nut The upper surface of the cover preferably comprises one or several patterns or orifices, each being prolonged, or not, by a conduit passing through at least part of the cover to bring a liquid in from said upper part to said lower part or identifying the position of a through conduit to be made, one or several of said plurality of patterns defining one or several positions at which the $1^{st}$ liquid connection means can be positioned and fixed using said means for maintaining said $1^{st}$ liquid connection means fixed relative to the cover.

A liquid can be an ink or a solvent of a continuous ink jet printer.

The upper surface and the lower surface are preferably approximately parallel with each other and with an ZY plane and perpendicular to a direction X. A peripheral surface is preferably at least partly parallel to the X direction.

A reservoir cover according to the invention may further comprise at least one $2^{nd}$ fluid or liquid connection means that can be removably fixed on the lower surface, to bring at least one liquid from an outlet of said through conduit and to direct at least some of it laterally, for example towards said peripheral surface or to a peripheral surface, for example formed by the inside wall of a reservoir on which the cover is positioned and which it closes.

The lower surface of the cover can also comprise one or several pattern(s) or orifice(s), each:

- being prolonged, or not, by a conduit passing through the cover or through at least part of the cover to bring at least one liquid from said upper part to said lower part;
- or identifying the position of a through conduit to be made, one or several of said pattern(s) or orifice(s) defining one or several position(s) at which the $2^{nd}$ fluid or liquid connection means can be positioned and fixed using means for maintaining said $2^{nd}$ fluid or liquid connection means relative to the cover.

Said means for maintaining comprise for example at least one of a screw or a quarter turn fastener or one or more clamp collar or one or more clips nut Said $2^{nd}$ fluid or liquid connection means can comprise at least one conduit and a $1^{st}$ chamber delimited by an internal surface in which said conduit opens up. The $1^{st}$ chamber, when the $2^{nd}$ fluid or liquid connection means is fixed on the lower surface, can also be delimited by said peripheral surface ($S_e$), at least one orifice being provided so that a liquid contained in this chamber can flow in a direction parallel to said peripheral surface.

At least one $2^{nd}$ fluid or liquid connection means can be removably fixed on the lower surface of the cover, to bring at least one fluid or liquid from an outlet of one of said through conduit(s) and to direct at least some of it laterally towards said peripheral surface ($S_e$).

Said $2^{nd}$ fluid connection means can comprise at least 2 conduits, preferably at least partly parallel to each other.

A cover according to the invention can comprise a plurality of through conduits, each passing through at least part of the cover to bring a fluid or a liquid from said upper surface or said upper part to said lower surface or said lower part of the cover.

A cover according to the invention can further comprise an evacuation conduit on the upper part of the cover and at least one condenser element that can be fixed on or to this evacuation conduit.

The invention also concerns a reservoir comprising a body and a cover according to the invention, including in particular a $2^{nd}$ fluid or liquid connection means (wherein said $2^{nd}$ fluid or liquid connection means comprises at least one conduit and a $1^{st}$ chamber delimited by an internal surface in which said conduit opens up), at least the $1^{st}$ chamber being closed laterally by the inner wall of the reservoir body.

Such a reservoir can further comprise means, for example at least a hydraulic circuit (comprising for example at least a duct and/or a conduit and/or a pump), for drawing off liquid from part of the reservoir and to circulate it to at least one $1^{st}$ liquid connection means, fixed removably on the upper surface, to bring at least part of said liquid to an inlet of a through conduit.

Such a reservoir can comprise a $1^{st}$ compartment, comprising at least a $1^{st}$ part called the upper part, and a $2^{nd}$ compartment delimited by a lateral wall, each of which can contain a liquid and the 2 compartments can be assembled to each other and can be separated or removed from each other.

The $1^{st}$ compartment may possibly comprise a removal extension volume, the $1^{st}$ part being included between the removable extension volume and the $2^{nd}$ compartment, when the 2 compartments and the removable extension volume are assembled to each other.

The removable extension volume prolongs the $1^{st}$ compartment, on one side of the compartment opposite the side to which the second compartment is or will be connected. This extension volume is designed to store the same liquid as the $1^{st}$ part of the $1^{st}$ compartment and communicates with this $1^{st}$ part such that they define a single storage volume larger than storage volumes defined by the extension volume alone and by the $1^{st}$ part of the $1^{st}$ compartment alone. The cover then closes the reservoir by closing the extension volume that also forms part of the $1^{st}$ compartment.

The $1^{st}$ compartment can be separated from the $2^{nd}$ compartment by a wall located between the $1^{st}$ compartment and the $2^{nd}$ compartment, when the 2 compartments are assembled to each other.

As a variant, the $1^{st}$ compartment comprises a $2^{nd}$ part, called the lower part that is located in the $2^{nd}$ compartment, the wall of which surrounds it when these 2 compartments are assembled to each other.

When such a reservoir is assembled, the $2^{nd}$ part of the first compartment then penetrates into the second compartment over a part of its length. Therefore this reservoir structure according to the invention makes it possible to use volumes $V_3$ and $V_4$ (FIG. 1) that remain unused in known structures, for the second compartment. Parts $V_1$ and $V_2$ of the solvent reservoir that remained unused in a known structure (FIG. 1), can in this case be used for other components of the circuit.

This $2^{nd}$ part may include a straight section or a section that becomes narrower or smaller as the distance from the $1^{st}$ part increases as far as a flow outlet orifice.

Or this $2^{nd}$ part may be delimited by a convergent shaped wall or it may comprise a section that becomes narrower or smaller as the distance from the $1^{st}$ part increases, and it can be closed at its point furthest from the $1^{st}$ part.

The invention also concerns an inkjet printer, preferably a continuous inkjet printer, comprising a print head, a reservoir as described above and in this description, at least one ink supply circuit to supply ink to said reservoir, at least one solvent supply circuit, to supply solvent to said reservoir, at least one circuit to supply ink to the print head, at least one circuit to return unused ink from the print head.

At least one of the circuits among the ink reservoir supply circuit and the ink return circuit can be connected to at least a $1^{st}$ liquid connection means, fixed removably on the upper surface of the cover.

A print method can use a device and particularly a reservoir according to the invention.

In particular, when printing on a print support using a print head:

- ink and/or solvent can be injected into a reservoir according to the invention; in particular ink can be injected with at least one $1^{st}$ fluid connection means that is removably fixed on the upper surface of the cover;
- and/or ink can be sent from a reservoir according to the invention to the print head;
- and/or ink not used for printing can be recovered from the print head and sent to a reservoir according to the invention, through at least one $1^{st}$ fluid connection means that is removably fixed on the upper surface of the cover;
- and/or ink can be drawn off in a lower part of a reservoir according to the invention and be sent to the upper part of this reservoir, through at least one $1^{st}$ fluid connection means that is removably fixed on the upper surface of the cover.

BRIEF DESCRIPTION OF THE DRAWINGS

Example embodiments of the invention will now be described with reference to the appended drawings among which.

Similar or identical technical elements are designated by the same reference numbers on the different figures.

DETAILED PRESENTATION OF EMBODIMENTS OF THE INVENTION

Figures 2A, 2B:
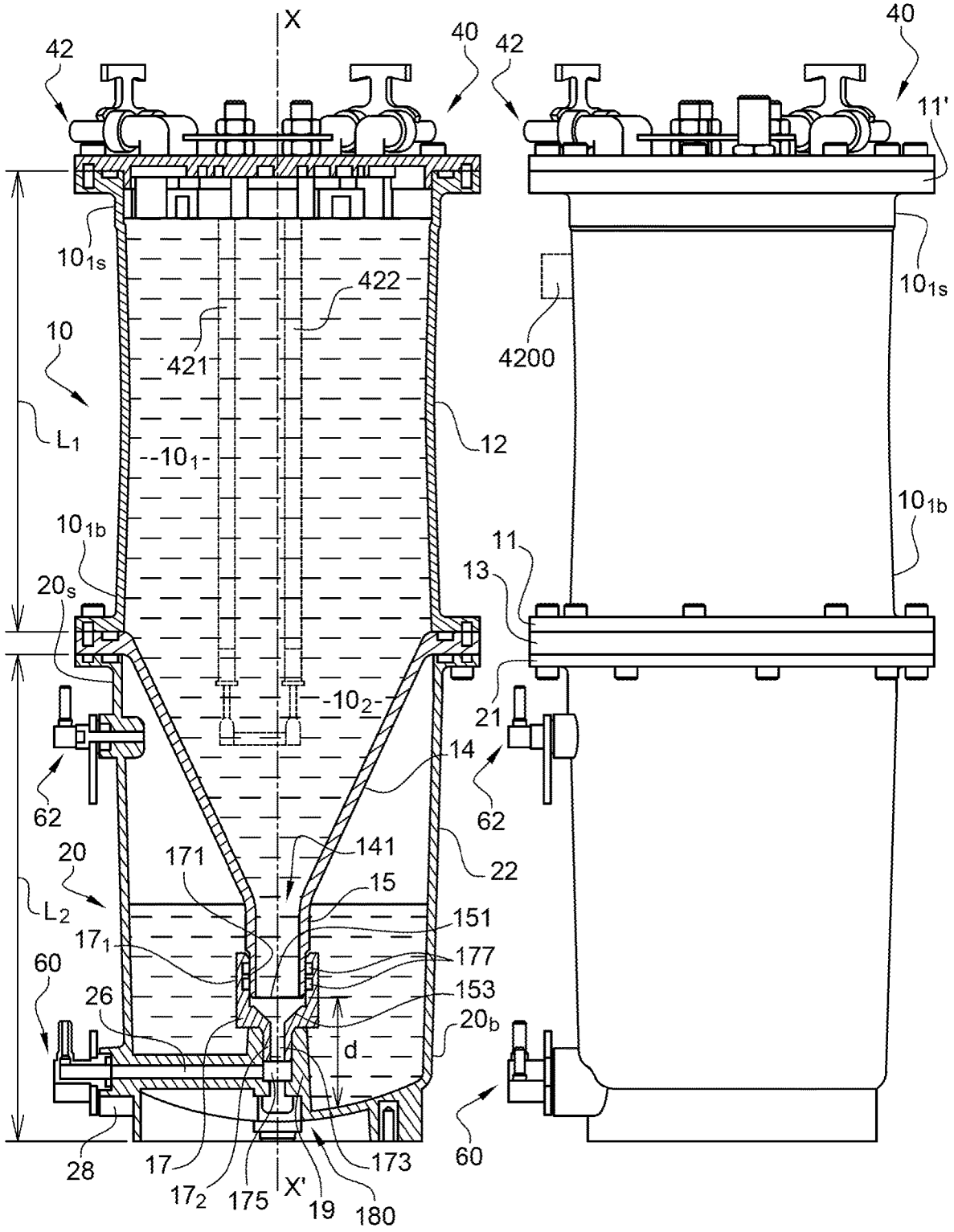
FIGS. 2A and 2B represent an example embodiment of a reservoir to which the invention can be applied.
Figure 2C:
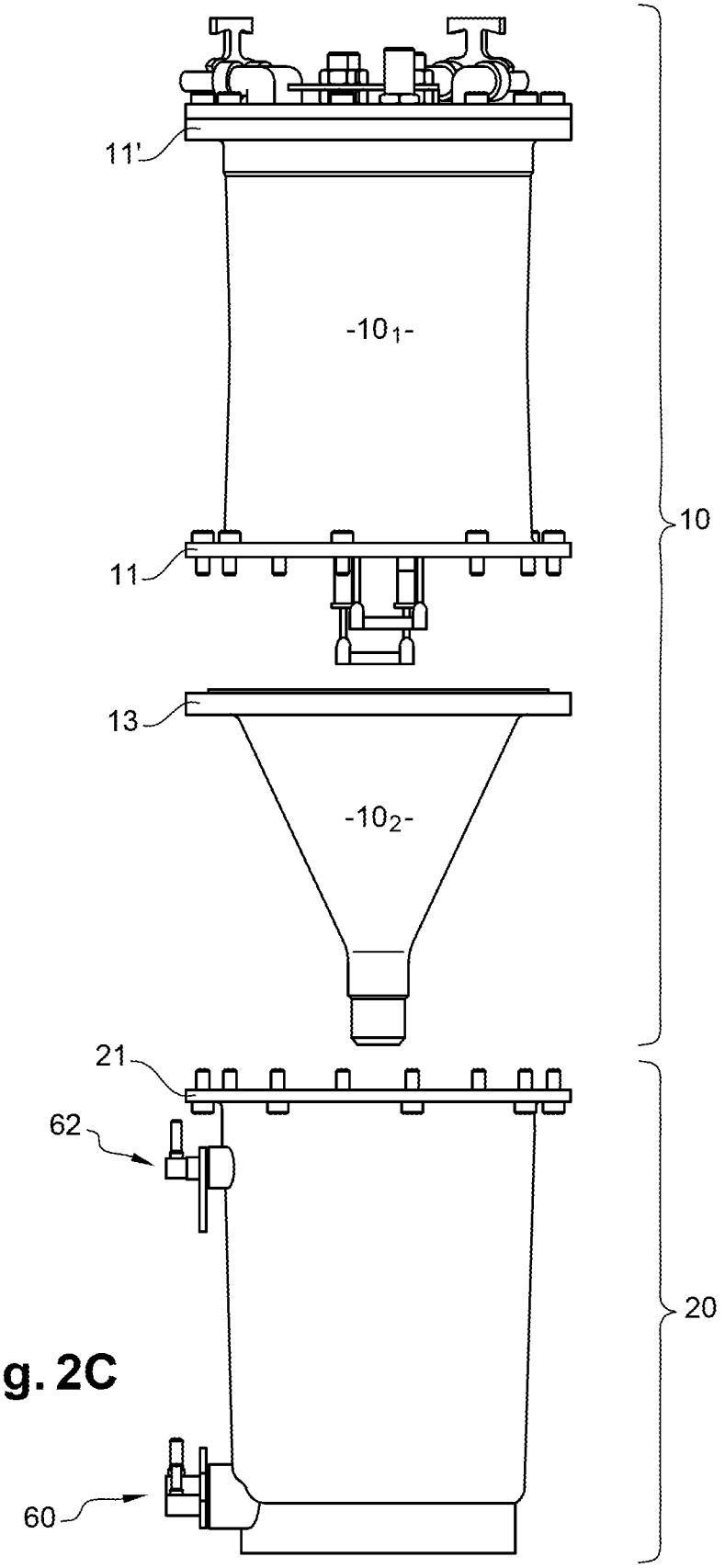
FIG. 2C represents an example embodiment of a reservoir to which the invention can be applied.
Figure 2D:
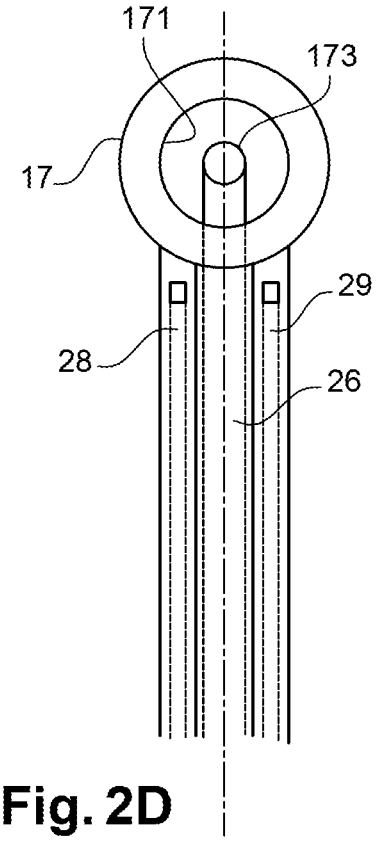
FIG. 2D represents one aspect of an example embodiment of a reservoir to which the invention can be applied.
Figures 2E, 2F:
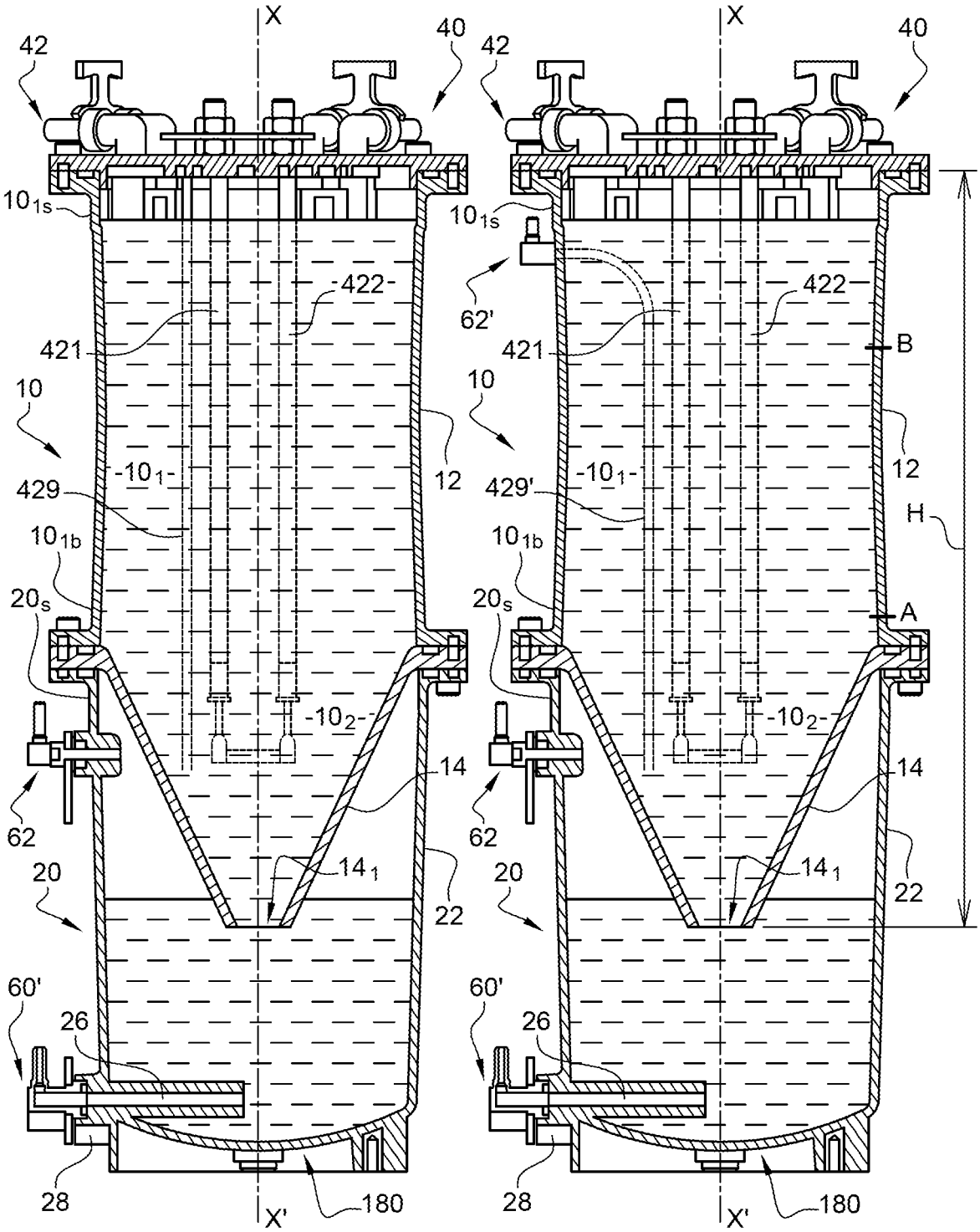
FIGS. 2E and 2F represent other example embodiments of a reservoir to which the invention can be applied.
Figure 11A:
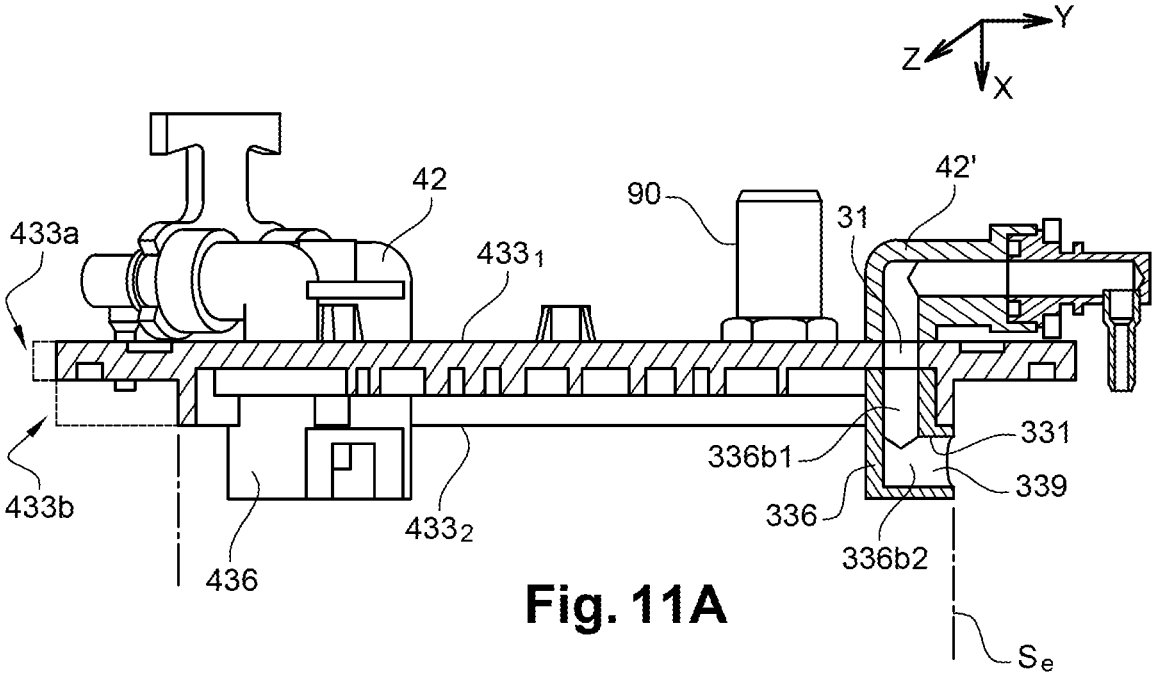
FIGS. 11A and 11B represent sectional views of embodiments of a cover according to the invention.
Figure 13:
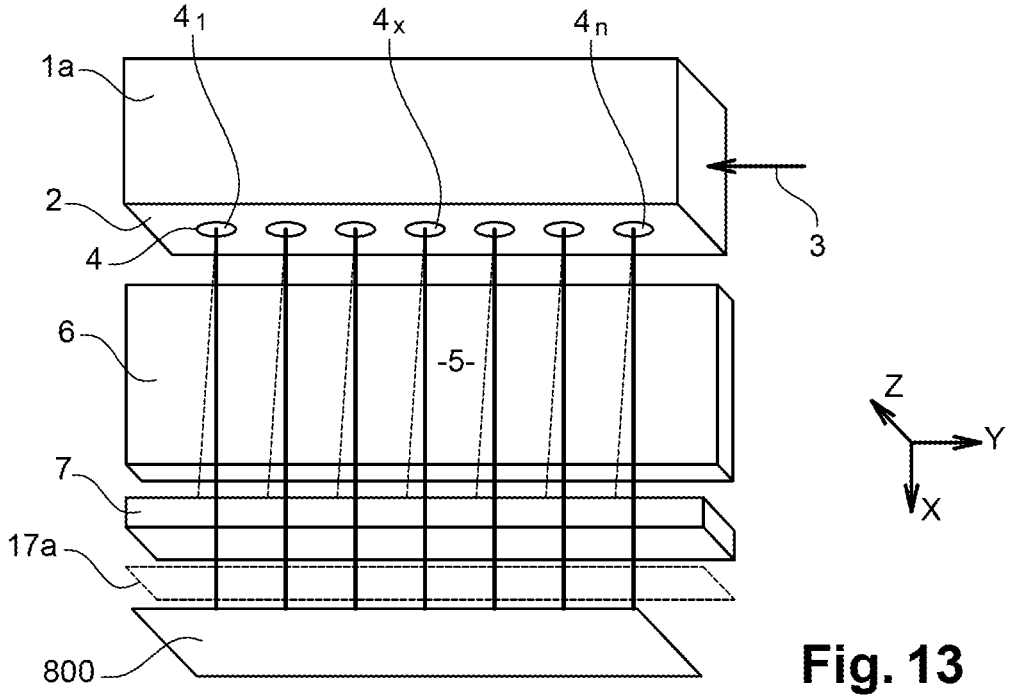
FIG. 13 shows an example structure of a print head of a printer to which the invention might be applied.

In this description, relative position information such as "upper", "lower", "top", "bottom" should be understood as being applicable when the reservoir is in its usage situation, aligned along the vertical of the location, namely along the flow direction of a liquid, which is direction XX' on FIGS. 2A, 2E, 2F or direction X on FIG. 11A or 13.

A first example embodiment of a reservoir to which a cover according to the invention can be applied is illustrated on FIGS. 2A-2C.

Such a reservoir has a fixed position relative to the printer when it is installed in said printer.

According to this first example, the reservoir comprises two compartments 10, 20 superposed one above the other when they are in an assembled position as illustrated in FIG. 2A.

The $1^{st}$ compartment 10 and/or the $2^{nd}$ compartment 20 has one or several walls made of a solid non-deformable material. The same applies for the wall(s) of the extension volume 50, described below, if there is one.

The $1^{st}$ compartment 10 may contain a $1^{st}$ liquid, the $2^{nd}$ compartment 20 may contain a $2^{nd}$ liquid, preferably different from the first liquid. For example, one of the 2 liquids is ink, the other is a solvent for this ink.

The first compartment 10, also called the upper compartment, extends between a top piece $\mathbf{10}_{1s}$, that will be closed by a cover 40 and a bottom piece $\mathbf{10}_{1b}$.

In the example illustrated, it comprises a $1^{st}$ part $\mathbf{10}_1$ delimited by a wall 12 with a cylindrical or principally cylindrical external and/or internal shape, that extends along an XX' axis (that is coincident with the vertical direction—or the flow direction of a liquid—when the reservoir is currently being used). Other shapes of the $1^{st}$ part $\mathbf{10}_1$ are feasible, for example the cross-section of this part in a plane perpendicular to the XX' axis may be rectangular or more generally polygonal, or the wall 12 may also form the straight walls of a straight prism.

In this example, this $1^{st}$ part is prolonged from its base by a $2^{nd}$ part $\mathbf{10}_2$ that comprises a tapered wall, or more generally a wall with a cross-section that gets narrower with increasing distance from the $1^{st}$ part and, in this example, as far as an outlet orifice 141. The wider portion of the 2nd part is assembled with the $1^{st}$ part. At the bottom of the $1^{st}$ part, the diameter or maximum dimension of the $2^{nd}$ part in a plane perpendicular to XX' is equal to the diameter or maximum dimension of the $1^{st}$ part. The internal volumes of the $1^{st}$ part and of the $2^{nd}$ part (or the $1^{st}$ compartment) are connected: in other words, these 2 assembled parts form a single compartment to contain the same liquid.

The external and/or internal shape of this $2^{nd}$ part $\mathbf{10}_2$ preferably matches the shape of the $1^{st}$ part: if the cross-section of the $1^{st}$ part $\mathbf{10}_1$ in a plane perpendicular to XX' is circular is rectangular or polygonal, or is a straight prism, then the cross-section of the $2^{nd}$ part in a plane perpendicular to XX' is identical, or correspond, to the cross-section of the $1^{st}$ part, and therefore in a plane perpendicular to XX' is circular or rectangular or polygonal, or is the cross-section of a straight prism respectively.

According to the embodiment illustrated in FIG. 2A, this second part $\mathbf{10}_2$ can be prolonged starting from an outlet orifice 141 by a part 15 (for example a conduit) designed for the outflow, that is also tapered (or that will also become narrower as the distance from the orifice 141 increases) or cylindrical (in which case its width or diameter is approximately the same as that of the orifice 141); it terminates in a flow orifice 151. As explained below, other means of drawing off a $1^{st}$ liquid in the first compartment can be made.

The $2^{nd}$ compartment 20, also called the lower compartment, extends between a top $\mathbf{20}_s$ and a bottom $\mathbf{20}_b$. It is delimited by a lateral wall 22, for example with an external and/or internal shape that can be cylindrical or have a generally cylindrical shape, and that extends along the XX' axis that surrounds or radially surrounds $2^{nd}$ part $\mathbf{10}_2$ of the first compartment 10, over the entire length (measured along the XX' axis) of this $2^{nd}$ part. In fact, the axial length of the $2^{nd}$ compartment 20 (along XX') is more than the axial length of the $2^{nd}$ part $\mathbf{10}_2$ of the first compartment 10. The $2^{nd}$ compartment 20 completely surrounds the 2nd part $\mathbf{10}_2$ of the 1st compartment when they are assembled, around 360°. Laterally, over the entire length (measured along the XX' axis) of this 2nd part, for example in any plane perpendicular to XX' and passing through this 2nd part $\mathbf{10}_2$, the 2nd compartment 20 surrounds, or completely surrounds, said 2nd part $\mathbf{10}_2$. The flow orifice 151 is located at a non-zero distanced from the bottom of the $2^{nd}$ compartment 20 when the $2^{nd}$ part $\mathbf{10}_2$ is fully engaged in the $2^{nd}$ compartment 20. Once again, other shapes of the $2^{nd}$ part of the compartment 20 are feasible depending on the external shape of the first compartment 10; for example the cross-section of this $2^{nd}$compartment 20 in a plane perpendicular to the XX' axis may be rectangular or more generally polygonal, or the wall 22 may also form the straight walls of a straight prism.

At least one or each of the two compartments 10, 20 can be symmetric about the XX' axis. This may possibly be a symmetry of revolution about this axis, for all or some of these compartments, preferably for both of them.

As can be understood from the sectional view in FIG. 2A, when the structure according to this example of the invention is assembled, the 2nd part $\mathbf{10}_2$ of the first compartment 10 penetrates into the second compartment 20 over part of the length of this compartment, but the 2 compartments are tight (or water tight) with respect to each other; in other words, a liquid contained in one of the 2 cannot flow into the other. Therefore the $2^{nd}$ part $\mathbf{10}_2$ of the first compartment 10 is contained in the second compartment 20. The $1^{st}$ part $\mathbf{10}_1$ of the first compartment 10 is outside the second compartment 20. The reservoir assembly extends from the bottom $\mathbf{20}_b$ of the $2^{nd}$ compartment to the top $\mathbf{10}_{15}$ of the $1^{st}$ compartment. The total length of the reservoir, measured along the XX' axis, is essentially equal to the length $L_2$ of the $2^{nd}$ compartment plus the length $L_1$ of the $1^{st}$ part of the $1^{st}$ compartment (possibly plus the thicknesses of the cover 40 and/or the flange 13).

Figure 1:
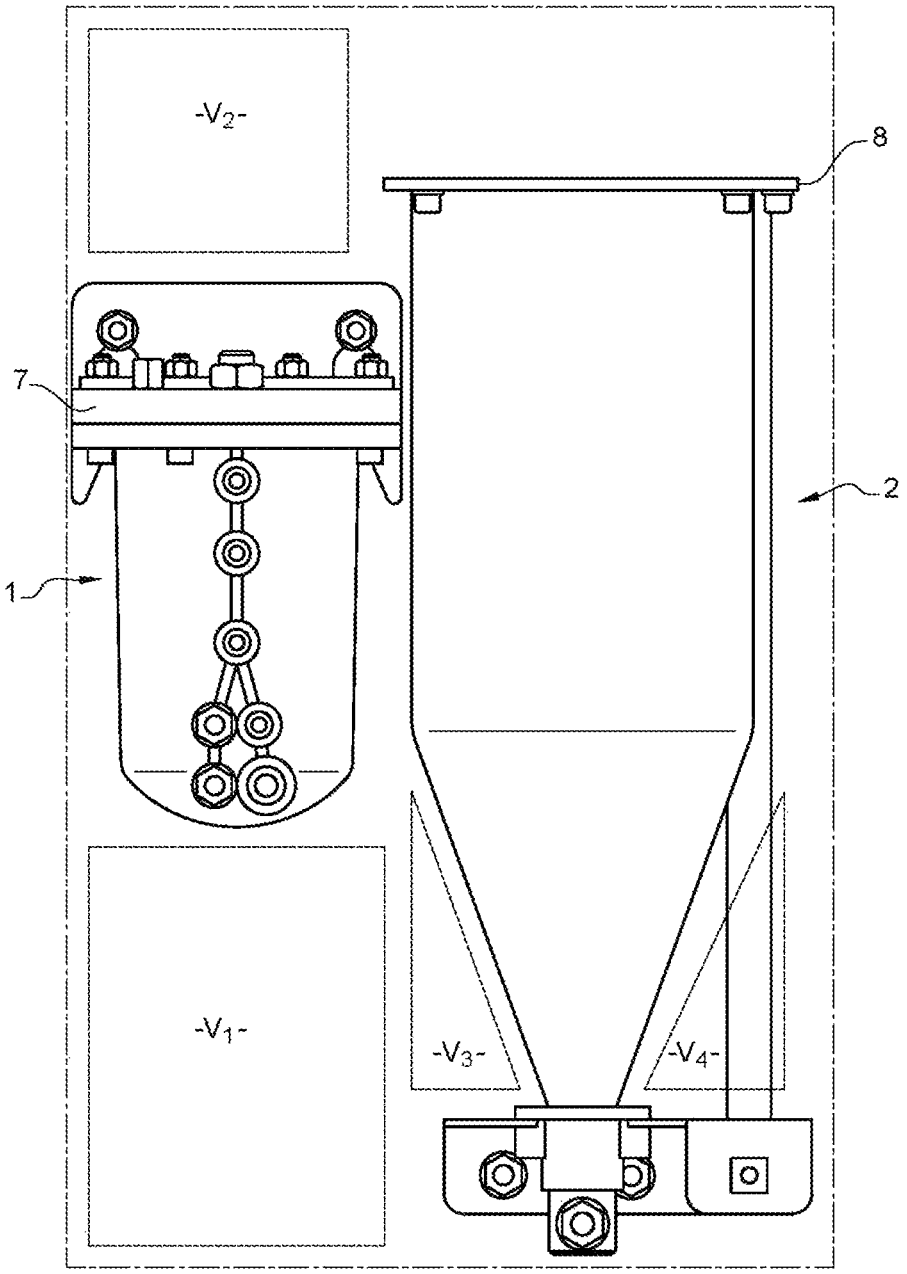
Fig. 1 (PRIOR ART)
FIG. 1 represents a view of a known structure of reservoirs of an inkjet printer.

The structure of the reservoir according to the invention makes it possible to use volumes $V_3$ and $V_4$ (FIG. 1) as part of the second compartment 20, while these volumes remain unused in known structures. Unlike a structure like that shown in FIG. 1, in which the reservoir 2 is entirely outside the reservoir 1, in this case the reservoir or the compartment 20 is around a part of the ink reservoir or compartment 10.

Therefore a space is released in the printer that can advantageously be used for other elements of the ink circuit or to reduce the overall size of the printer.

In the context of use in an inkjet printer, the first compartment 10 can be used as an ink reservoir, while the second compartment 20 is then used as a solvent reservoir, the two being assembled so as to be tight or leaktight relative to each other.

As a variant, and also in an inkjet printer, the first compartment 10 can be used as a solvent reservoir, while the second compartment 20 is then used as an ink reservoir, the two being assembled to be tight or leaktight relative to each other. This means that solvent can be topped up by gravity.

In one numerical example, the volume of the first compartment 10 (ink reservoir) is about 1000 $cm^3$ (or more generally is between 800 $cm^3$ and 1500 $cm^3$ or even 2000 $cm^3$) while the volume of the second compartment 20 (additive or solvent reservoir) is about 300 $cm^3$ (or more generally, is between 200 $cm^3$ and 500 $cm^3$ or even 800 $cm^3$).

As can be understood from FIGS. 2A-2C, the two compartments are initially separated from other, and they are then assembled using flanges 11, 21 (FIG. 2B) that form part of the first compartment 10 and more precisely at the periphery of the bottom $\mathbf{10}_{1b}$ of the $1^{st}$ part $\mathbf{10}_1$, and the second compartment 20 (located at the top of this $2^{nd}$ part, at the periphery of the top $\mathbf{20}_s$) and that grips a flange 13 located at the periphery of the bottom of the $2^{nd}$ compartment of the part $\mathbf{10}_2$ (the cross-section of which narrows) in a sandwich layout. The assembly is held in place for example by screwing flanges.

The top $\mathbf{10}_{1s}$ of the upper compartment can be closed by a cover 40 (detailed examples of cover structures are given below), that can be fixed to a flange 11' (FIG. 2B), located at the periphery of this top $\mathbf{10}_{1s}$ of the first compartment 10, for example by screwing.

The cover 40 can be fitted with level measurement rods 421, 422 to be able to identify the level of ink contained in the reservoir 10.

Another technical advantage of a reservoir structure which can be used in combination with a cover according to the invention consists of using a single cover 40 for the two compartments, the first compartment 10 itself acting as a cover for the second compartment 20.

In the example illustrated on FIG. 2A, the liquid flow from the 1st compartment takes place through the part 15, connected to a conduit 26 (FIG. 2A) that passes through the lateral wall 22 of the $2^{nd}$ compartment in a lower part of the second compartment. For example, this conduit 26, preferably directed approximately perpendicular to the direction XX' (that is the direction of liquid flow in parts 14 and 15 when the device is in the vertical usage position), is made in a part formed as a single piece with the wall 22 and/or with the bottom of the $2^{nd}$ compartment. The part 15 may be connected to the conduit 26 by an adaptor part 17 that is higher than the bottom of the $2^{nd}$ compartment 20 and that centres the end of the conduit 15.

According to one example embodiment, this part 17 comprises a first part $\mathbf{17}_1$, that may have a cylindrical external shape and that is provided with a cylindrical or approximately cylindrical bore 171, into which the end of the conduit 15 can fit. This bore can be prolonged by a tapered part 153 that leads to a conduit 173 oriented towards the XX' axis and that opens up at a bend 175 that communicates with the conduit 26. The first part $\mathbf{17}_1$ of this part 17 is prolonged by a second part $\mathbf{17}_2$, that may also have a cylindrical external shape, but with an outside diameter less than that of the first part and through which the conduit 173 passes. It is inserted into a reaming formed in an approximately cylindrically shaped part 19 that is raised above the bottom of the second compartment 20. The assembly holds the part $\mathbf{10}_2$ of the $1^{st}$ compartment 10 firmly in a centred position.

In general, in this example and in the examples described below, care is taken to create a tightness (or leak tightness) seal between the $2^{nd}$ compartment 20 and the $1^{st}$ compartment 10, particularly at the interface between the flanges 11, 21 and the edge (or the flange) 13 and/or in the vicinity of and/or around the part 15 and/or the flow orifice 151 and/or over the entire fluid path of the 1st compartment in the conduit 26. For example, this leak tightness may be obtained by the use of one or several joints.

In particular, the bore of the part 17 may be fitted with leaktight or sealing means, for example one or several joints 177 that will form a barrier to prevent any infiltration of liquid from the $1^{st}$ compartment into the $2^{nd}$ compartment.

As a variant, the part 17 can be replaced by a joint making the leak tight connection between the compartments 10 and 20.

The flow of liquid from the $2^{nd}$ compartment may take place through a conduit 28 (FIGS. 2A, 2D) that also passes through the lateral wall 22 of the $2^{nd}$ compartment through an orifice formed in the lower part of this compartment.

Liquid may possibly be introduced into the $2^{nd}$ compartment through a conduit 29 (FIG. 2D) that also passes through the wall 22 of the $2^{nd}$ compartment in a lower part of this compartment. In this case, FIG. 2D represents a top view of the part 17 and the flow conduits 28 and 29, that will draw off liquid from the $2^{nd}$ compartment 20 or add liquid into this $2^{nd}$ compartment 20 respectively.

As will be understood, in the embodiment shown in FIGS. 2A and 2B, the conduits 28, and possibly 29, open up directly into the $2^{nd}$ compartment 20; they are preferably arranged on each side of the conduit 26 and/or parallel to this conduit that connects the outlet 151 from the conduit 15 and the exterior of the $2^{nd}$ compartment.

The $1^{st}$ part $\mathbf{10}_1$ and the $2^{nd}$ part $\mathbf{10}_2$ of the $1^{st}$ compartment can be disassembled from each other, as can also the 2 compartments 10, 20 as can be understood from the view in FIG. 2C that illustrates the reservoir assembly in the disassembled state and that illustrates the assembly steps (for example assembly of the $1^{st}$ part $\mathbf{10}_1$ and the $2^{nd}$ part $\mathbf{10}_2$ then assembly of this assembly with the $2^{nd}$ compartment 20).

During assembly, the flange 13 located at the bottom of part $\mathbf{10}_2$ is trapped between flanges 11 and 21. Holes, possibly threaded, formed in these different parts, can be used with screws or any other adapted tightening means, to hold the assembly together as a single unit. The end of the part 15 fits into the bore 171 of the adapter part 17 that itself fits into the bore of the part 19. Firstly, one or more joints 177 can have been placed such that the flow from the first compartment 10 is leaktight.

The following are also illustrated in a side view in FIGS. 2A-2C:

- fluid connection means 60, to draw off liquid flowing from the first compartment (through the conduit 26) and to draw off liquid from the bottom of the second compartment (through the conduit 28) and/or possibly to introduce liquid into this compartment (through the conduit 29);
- possibly fluid connection means 62 in the part adjacent to the top $\mathbf{20}_S$, to create a communication between the two compartments; in particular, these means 62 communicate through at least one orifice made in the wall 22, with the internal atmosphere of the $2^{nd}$ compartment 20.

Figure 3:
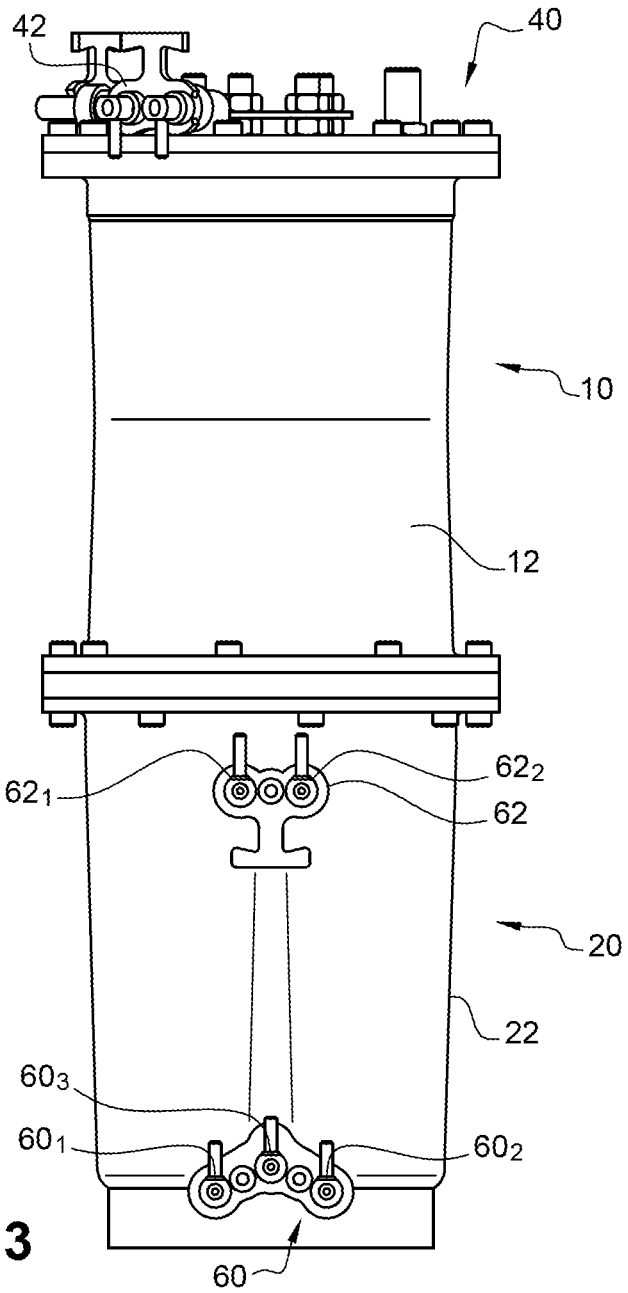
FIG. 3 represents another view of an example embodiment of a reservoir with its fluid connection means, to which the invention can be applied.

These various means 60, 62 are shown in a front view in FIG. 3, along the wall 22 of the second compartment 20. As can be seen on this figure, each of the outputs $\mathbf{60}_1$, $\mathbf{60}_2$, $\mathbf{60}_3$, $\mathbf{62}_1$, $\mathbf{62}_2$ from these means 60, 62 can be fitted with a connector, for example a "firtree" type connector, in order to better connect a conduit.

According to one preferred embodiment, the means 60 that are preferably made at the bottom of the second compartment 20 to make an easy communication with conduits 26, 28, 29, comprise a set of 3 inlets/outlets (I/O) (one $\mathbf{60}_1$ for inlet of solvent, the other $\mathbf{60}_2$ for outlet of solvent, and a third $\mathbf{60}_3$ for outlet of ink from the bottom of the reservoir 10).

In the example represented, the means 62 are made close to the top of the second compartment 20; there is a fluid communication with the atmosphere inside the $2^{nd}$ compartment 20 and they can be used for example to balance the internal pressure in the atmosphere above the liquid contained in the $2^{nd}$ compartment 20 and the pressure in the $1^{st}$ compartment 10. For example, a conduit (not shown in FIG. 3) can connect an outlet from the means 62, with fluid connection means such as the means 42 located, in this example, on the cover 40 and from which a fluid connection can be made with the atmosphere inside the $1^{st}$ compartment 10.

The means 42 may be provided with several inlets. One of them was already mentioned above, for balancing the pressure between compartments 10 and 20.

Another input of the means 42 is for bringing back, or for returning, the $1^{st}$ liquid (for example ink) through a conduit not shown on FIG. 3 and through means 60 and a conduit, from the bottom (in other words close to the orifice 151) of the $1^{st}$ compartment 10 in (or into) its upper part, and also possibly to introduce the $2^{nd}$ liquid (or part of it) from the $2^{nd}$ compartment (for example solvent) into this $1^{st}$ compartment 10. The return of liquid into the $1^{st}$ compartment 10, from the bottom of this compartment causes mixing of the liquid contained in this compartment (which is particularly advantageous in the case of a pigmented ink) and solvent can possibly be added to adjust the viscosity of the ink.

Another inlet of means 42 through a conduit that returns from the print head and that is not shown in FIG. 3, could also be added to return ink not used for printing back into the first compartment 10.

Another inlet of means 42 could be used to connect the compartment 10 to an ink supply circuit, itself connected to an ink cartridge, to add fresh ink, through a conduit not shown in FIG. 3. As a variant, these different functions that consist of bringing ink into or out of the reservoir 10 can be performed by means 4200 (see FIG. 2B) forming a connector located along the wall 12, facing one or several orifices in this wall, preferably in its upper part. For example, these means 4200 may be identical or similar to the means 60, 62 described previously.

When the $2^{nd}$ compartment contains ink, ink from the print head can be returned and the connection with the ink supply circuit can be made through the conduit 29 or through the means 62 that may then comprise more outlets of the same type as outlets $\mathbf{62}_1$, $\mathbf{62}_2$.

Example embodiments of the cover 40 and its means 42 are described below.

FIG. 2A shows one aspect of a particular embodiment: means 310 for example such as one or several screws can be located in the bottom of the $2^{nd}$ compartment 20; these means can be used to drain the two compartments 10, 20 through the lower part of the device, for example by "manual" opening.

Another example embodiment of a reservoir to which a cover according to the invention can be applied is illustrated on FIG. 2E.

In this other example, as in the first example, the reservoir comprises two compartments 10, 20 superposed one above the other when they are in an assembled position as illustrated in FIG. 2E.

But liquid from the $1^{st}$ compartment can be drawn off using a conduit or a pipe 429 that is immersed in this $1^{st}$ compartment and that brings this liquid by pumping towards the outside of the reservoir through the cover 40 or to a connector 62' located along the reservoir 10, for example as shown on FIG. 2F or located lower down along the wall 12. As another variant, liquid (for example ink) can be drawn off as described in application EP 2298123, through a conduit arranged so as to draw off in a median zone of the $1^{st}$ compartment, for example located between:

- a first level A, defined by a level located at not less than $1/20^{th}$ or $1/10^{th}$ or $1/4$ or $1/3$ of the height of the $1^{st}$ compartment, measured from its lowest point $\mathbf{14}_1$, as a proportion of the height H of the $1^{st}$ compartment (itself measured between the lowest point $\mathbf{14}_1$ and the highest point of the $1^{st}$ compartment, when it is in operation),
- and a second level B defined by the upper third or quarter (once again measured as a proportion of the height H of the $1^{st}$ compartment, as explained above).

In this median zone, between levels A and B, the concentration of a pigmented ink remains approximately constant and equal to the initial nominal concentration.

If liquid is drawn off from the $1^{st}$ compartment through a conduit or a pipe, there is no longer a need to have all the means 15, 17, $\mathbf{17}_1$, 26, $\mathbf{60}_3$ to bring the liquid flow from the $1^{st}$ compartment, as can be seen on FIG. 2E. The lower end $\mathbf{14}_1$ of the $2^{nd}$ part of the $1^{st}$ compartment can be closed, as can be seen on FIG. 2E.

The outer aspect of the reservoir is also similar to what is shown in FIGS. 2B and 3 and, in the disassembled state, to what is shown in FIG. 2C.

In other words, except for drawing off liquid from the $1^{st}$ compartment, the various aspects and technical advantages explained above in relation to the previous embodiment can be kept, particularly the advantages related to the compactness of the system and fabrication of the single cover 40. Similarly, the liquid flow from the $2^{nd}$ compartment can be the same as in the previous embodiment, through the conduit 28. The means 60', once again preferably made at the bottom of the second compartment 20 to make an easy communication with conduits 26 and 28, comprise a set of 2 inlets/outlets (I/O) (one $\mathbf{60}_1$ for inlet of liquid into this $2^{nd}$ compartment, the other $\mathbf{60}_2$ for outlet of solvent from this $2^{nd}$ compartment).

It can be noted that regardless of which embodiment is adopted, as a variant, means can also be provided to:

- draw off liquid from the $2^{nd}$ compartment 20 through a conduit that is outlet laterally from the top of the wall of this $2^{nd}$ compartment (for example using means, or the hydraulic connector, 62);
- and/or draw off one of the 2 liquids from the bottom, through the bottom wall 180 of the $2^{nd}$ compartment.

Figure 4A:
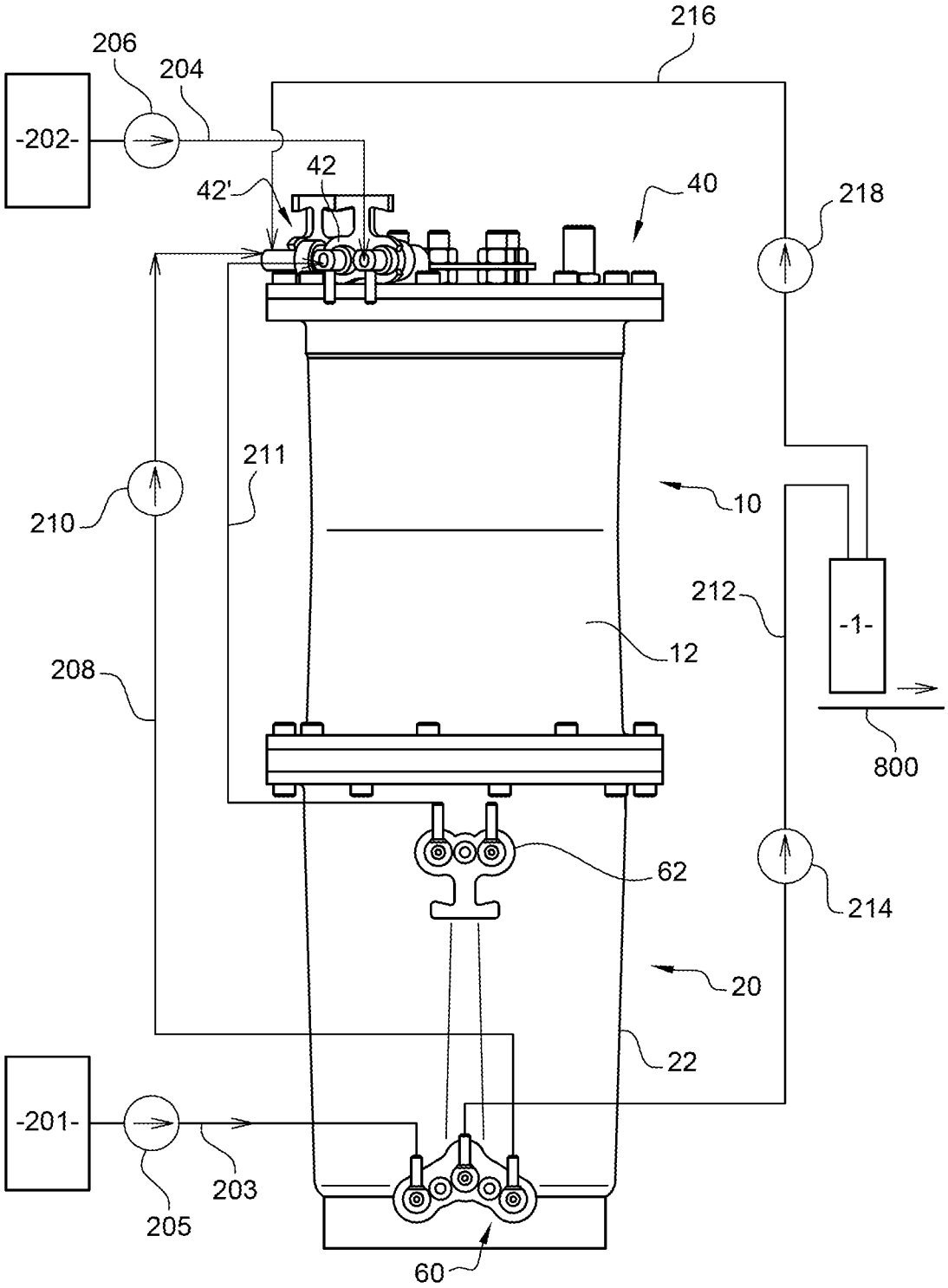
FIGS. 4A and 4B represent embodiments of fluid circuits for the example of embodiments of a reservoir incorporating the invention.

FIG. 4A diagrammatically shows a fluid circuit of an inkjet printer, this circuit comprising a reservoir according to the first example described above (FIGS. 2A-2D).

References 201 and 202 designate solvent and ink cartridges respectively, that can be moved relative to the rest of the circuit. These cartridges can be removed, either to replace them by new cartridges, or for example for maintenance of the circuit.

A supply circuit 203 is for sending solvent from this cartridge 201 to the reservoir compartment 20, through an inlet to the connection means 60. In particular, this circuit 203 comprises a pump 205.

A supply circuit 204 is for sending ink from the cartridge 202 to the reservoir compartment 10, through an inlet to the connection means 42. In particular, this circuit 204 comprises a pump 206.

A supply circuit 208 is for sending solvent from the compartment 20 through an output from the connection means 60 to the compartment 10, through an inlet to the connection means 42. In particular, this circuit 208 comprises a pump 210.

A conduit 211 connects an outlet from the connection means 62 and an inlet to the means 42' (similar or identical to the means 42) of the compartment 20, to balance pressures between the atmospheres in the two compartments, as already described above. As mentioned above, according to one variant, these means 42, 42' can be replaced and/or supplemented by means 4200 located adjacent to the wall 12.

A supply circuit 212 is for sending ink from the compartment 10 through an outlet from the connection means 60 to the print head 1. This circuit 212 comprises a pump 214.

A return circuit 216 sends ink not used for printing from the head 1 to the compartment 10, through an inlet to the connection means 42'. This circuit 216 comprises a pump 218. Each of the supply and return circuits is shown in a simplified manner on FIG. 4A. It may comprise one or several conduits and one or several valves.

Figure 4B:
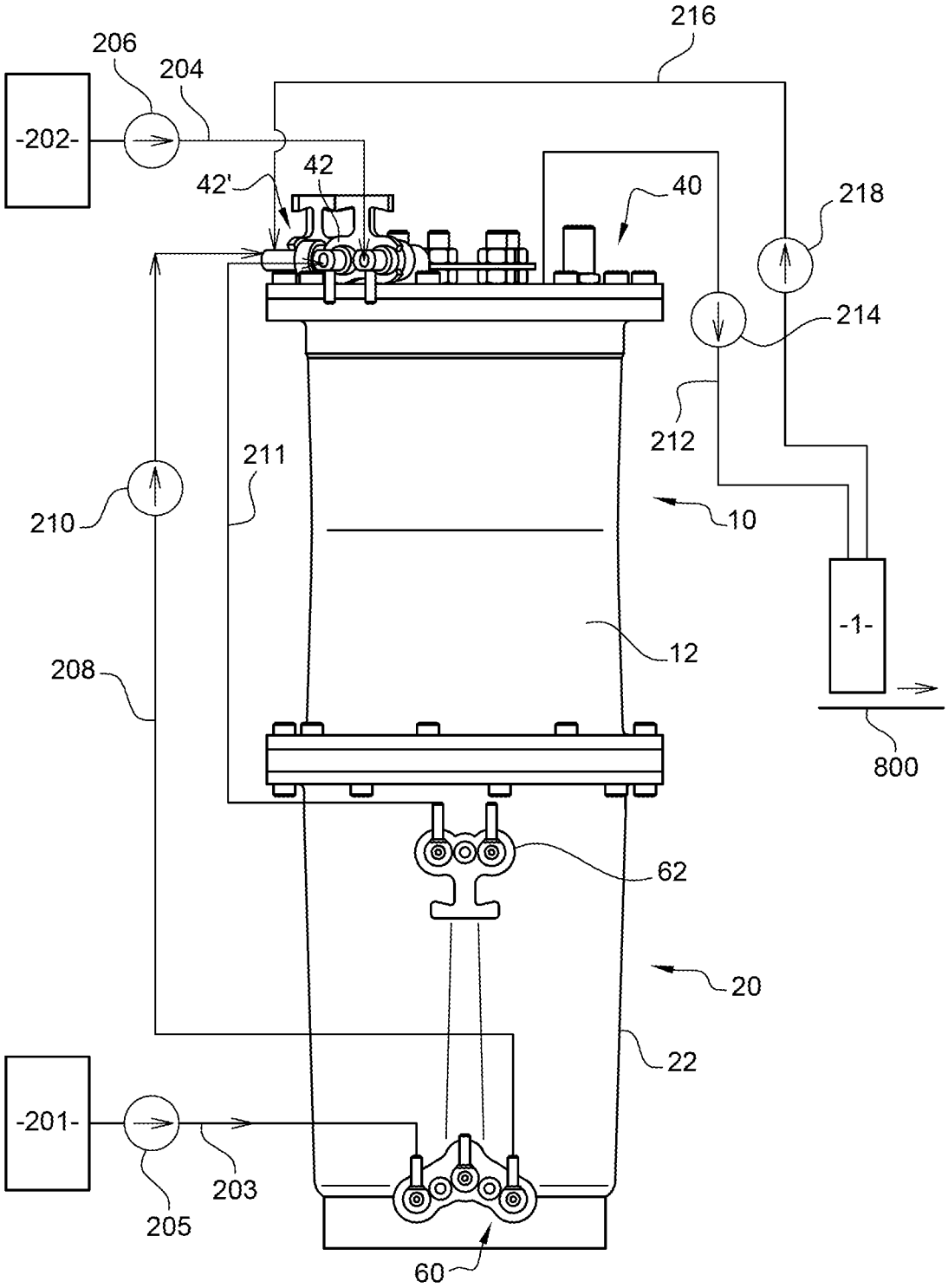

FIG. 4B diagrammatically shows a fluid circuit of an inkjet printer, this circuit comprising a reservoir according to the second example described above (FIG. 2E). Numerical references identical to those in FIG. 4A denote the same elements. Ink can be drawn off from the top of the $1^{st}$ compartment, through the pump 214. In the embodiment in FIG. 2F, the pump 214 would be connected to means 62' located along the wall 12.

Regardless of the embodiment (among those described above or those described below, particularly with reference to FIGS. 5A-5E or FIGS. 6A-12), a portal frame (more generally support means) not shown are used to install the print head 1 facing a print support 800 that moves along a direction materialised by an arrow. This direction is perpendicular for example to an alignment axis of the nozzles. The print head is preferably maintained at a distance from the print support 800 that can be at least 4 mm or 5 mm. The print support 8 can have a non-plane surface, in which case the portal (or more generally support means) can be controlled so as to keep the print head at an appropriate distance depending on the geometry of the support 8.

An example of a print head 1 comprising means of forming one or several jets, is explained below, with reference to FIG. 13.

The head includes a drop generator 1*a*. This generator comprises an integer number n of nozzles 4 aligned on a nozzle plate 2 along an Y axis (lying in the plane of the figure), including a first nozzle $\mathbf{4}_1$ and a last nozzle $\mathbf{4}_n$.

The number n of nozzles in the device may vary from 1 to several tens, for example 64 or 128.

In the view shown in FIG. 13, the first nozzle and the last nozzle ($\mathbf{4}_1$, $\mathbf{4}n$) are the nozzles that are furthest from each other.

Each nozzle has a jet emission axis parallel to a X direction or axis (located in the plane of FIG. 13), perpendicular to the nozzle plate and to the Y axis mentioned above. A third axis, Z, is perpendicular to each of the X and Y axes, the two Y and Z axes extending in the plane of FIG. 13.

The nozzle $\mathbf{4}_x$ can be seen on the figure. Each nozzle is in hydraulic communication with a pressurized stimulation chamber. The drop generator comprises one stimulation chamber for each nozzle. Each chamber is provided with an actuator, for example a piezoelectric crystal. An example design of a stimulation chamber is described in document U.S. Pat. No. 7,192,121.

There are sort means or a sort module 6 downstream from the nozzle plate, that will be used to separate drops used for printing from drops or jet segments not used for printing.

These means of separating drops or segments in one or several of said jets that are intended for printing from those not used for printing may also comprise at least one electrode formed in contact with or within a wall that delimits the cavity inside which the jets are produced. At least one electrode may be flush with the surface of the wall in question. Thus, drops or segments that are not used for printing are deviated by the electrostatic effect of at least one electrode on the drops.

The drops or jet segments emitted by a nozzle and that will be used for printing follow a trajectory along the X axis of the nozzle and strike a print support 800, after having passed through an outlet slit 17*a*. The slit is open to the outside of the cavity and ink drops to be printed exit through it; it is parallel to the Y direction of nozzle alignment, the axes of the nozzles along the X direction passing through this slit, that is on the face opposite the nozzle plate 2. Its length is equal to at least the distance between the first and the last nozzle.

The zone in the space in which ink circulates between the nozzle plate 2 and the outlet slit 17*a* for drops to be used for printing or between the nozzle plate and the catcher (or gutter) 7 is called a "cavity". The nozzle plate 2 actually forms an upper wall of the cavity. Laterally, the cavity is for example delimited by lateral walls, approximately parallel to the curtain of jets formed by the different jets emitted by the nozzles. One of these walls has already been mentioned above, with reference to a jet deviation electrode.

Drops or jet segments emitted by a nozzle and not intended for printing, are deviated by means 6 and are recovered in a catcher 7 and this ink is then recycled (for example using the circuit 216 in FIG. 4). The length of the catcher along the Y direction is equal to at least the distance between the first and the last nozzle.

A reservoir as disclosed above and below with a particularly optimised ink capacity is very advantageous for the case of a print head comprising n nozzles in which n is, for example, between 10 and 200.

Regardless of which embodiment is envisaged, the instructions to activate the means in the print head to produce one or more ink jets and/or pumping means and/or opening and closing valves on the path of the different fluids (ink, solvent, gas) and/or to control the means of holding the print head can be sent by the control means (also called the "controller") of a printer. In particular, these are the instructions that cause circulation of ink under pressure towards the print head, then generate jets as a function of motifs to be printed on a support. These control means may for example be made in the form of a processor or a microprocessor programmed in particular to implement a print process that can be done at the same time as the different fluids are circulating in the different circuits explained above.

The advantage in volume conferred by the reservoir structure as disclosed herein can be enhanced by prolonging the $1^{st}$ part of the $1^{st}$ compartment 10' by an extension volume 50, that is mobile relative to or removable from said $1^{st}$ part and communicating with it such that the liquid volume that can be contained in this entire $1^{st}$ part and its extension 50 is larger than what can be contained in the $1^{st}$ part $\mathbf{10}_1$ alone or in the extension volume 50 alone.

The volume of the compartment 10, formed by the extension volume 50 of the $1^{st}$ part and possibly the $2^{nd}$ part, is connected.

The $1^{st}$ part $\mathbf{10}_1$, in the assembled state of the reservoir, is contained firstly between the extension volume 50 and secondly the $2^{nd}$ part $\mathbf{10}_2$ (when it is present) and the $2^{nd}$ compartment.

This structure is represented in FIGS. 5A-5E.

The shape of the inside and/or outside of the extension volume 50 is preferably approximately cylindrical or more generally, has the same external and/or internal shape as the $1^{st}$ part $\mathbf{10}_1$. It can be connected to the $1^{st}$ part $\mathbf{10}_1$ by a flange 51, located at one of its ends 51*s* and assembled (for example screwed) with the upper flange 11' of the $1^{st}$ part $\mathbf{10}_1$, itself always located above the $2^{nd}$ compartment 20.

Thus, as can be seen in the sectional views on FIGS. 5B-5E, the internal volume of the reservoir composed of the $1^{st}$ part $\mathbf{10}_1$ and its extension volume 50 is more than or very much more than (it can be almost doubled) the volume of the $1^{st}$ part $\mathbf{10}_1$ alone of the configuration described above with reference to FIGS. 2A-2F.

The top of the extension volume 50 can be closed by the same cover 40 as that used to close the $1^{st}$ part $\mathbf{10}_1$ in the previous embodiments. Therefore the cover 40 closes the extension volume 50 (and therefore the compartment 10), such that it can be removed or disassembled, in the same way as the cover 40 closes the $1^{st}$ part $\mathbf{10}_1$ in FIGS. 2A-3. Fluid can be added into the extension volume 50 and/or the pressure can be balanced with the lower compartment 20, in the same way as described above, by means of the cover 40 or laterally, by a hydraulic connector such as the connector 4200 (FIG. 2C), but this time made along the wall of the extension volume 50.

The technical advantage obtained with the embodiments with an extension volume 50 is that of a very large internal volume of the $1^{st}$ compartment, including the extension volume, the $1^{st}$ part and possibly the $2^{nd}$ part when they are assembled; according to one example, the global inside volume of the compartment 10, with an extension volume 50, is 1800 $cm^3$ or, more generally, is between 1000 $cm^3$ or 1500 $cm^3$ and 2000 $cm^3$; such an internal volume is particularly well adapted to multi-jet type application, in which ink jet flows are high. The volume of the additive compartment 20 (for example between 200 $cm^3$ and 500 $cm^3$) may be the same as in previous embodiments.

Another advantage is the adaptability of this structure, since the extension volume can be installed (as illustrated in FIGS. 5A-5E) and then removed (to give the structure shown in FIGS. 2A-3).

Figure 5A:
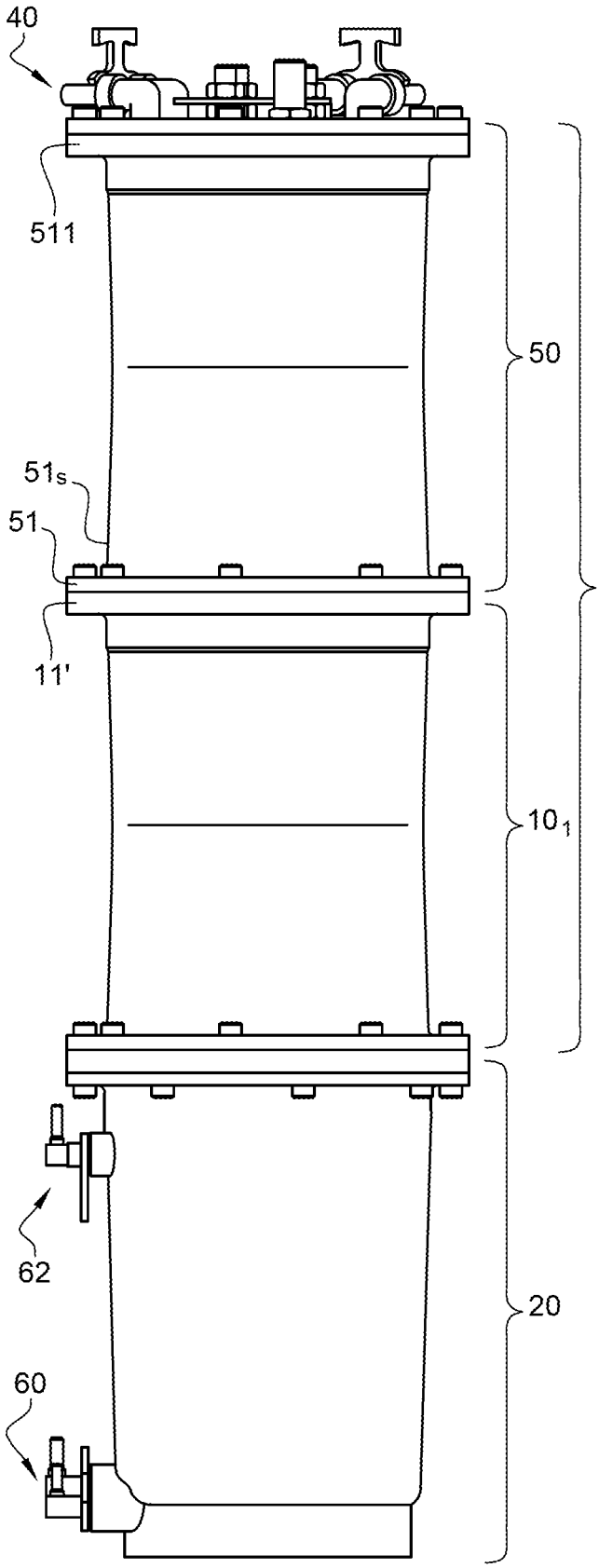
FIGS. 5A-5E represent variant embodiments of a reservoir incorporating the invention.
Figure 5B:
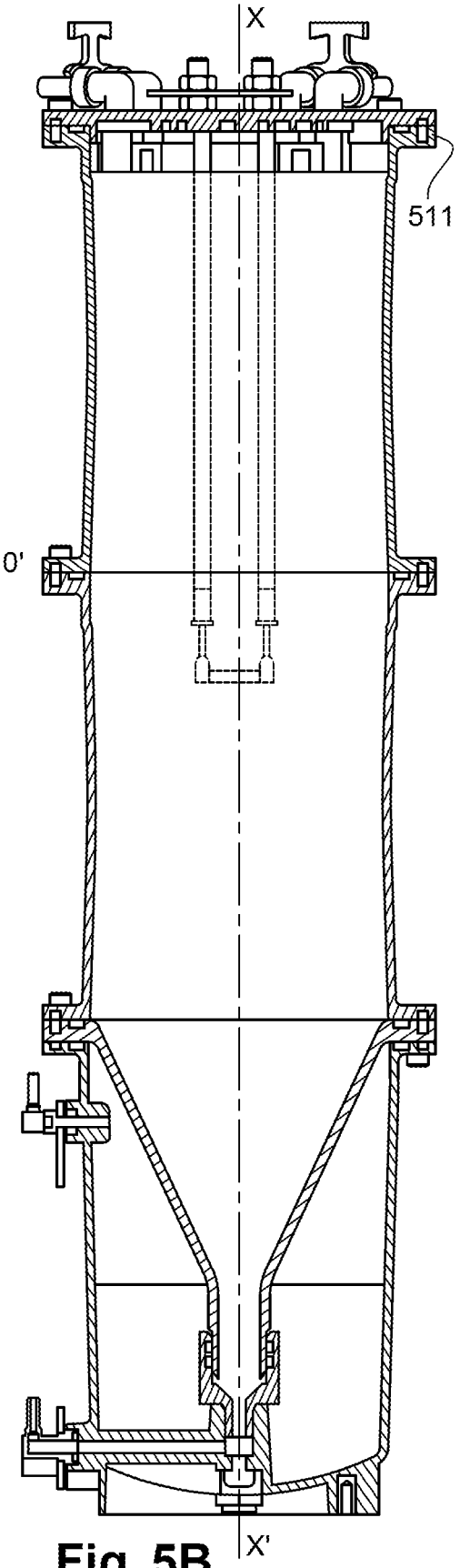

In the embodiment shown in FIGS. 5A-5B, the other parts of the device already presented above, are unchanged: this includes the compartment 20, drawing off or fluid flow means located at the bottom of the $2^{nd}$ compartment, fluid connection means 60, 62 if any along the $2^{nd}$ compartment and possibly the cover 40. Therefore this embodiment does not induce any changes to parts that have already been presented.

Figure 5C:
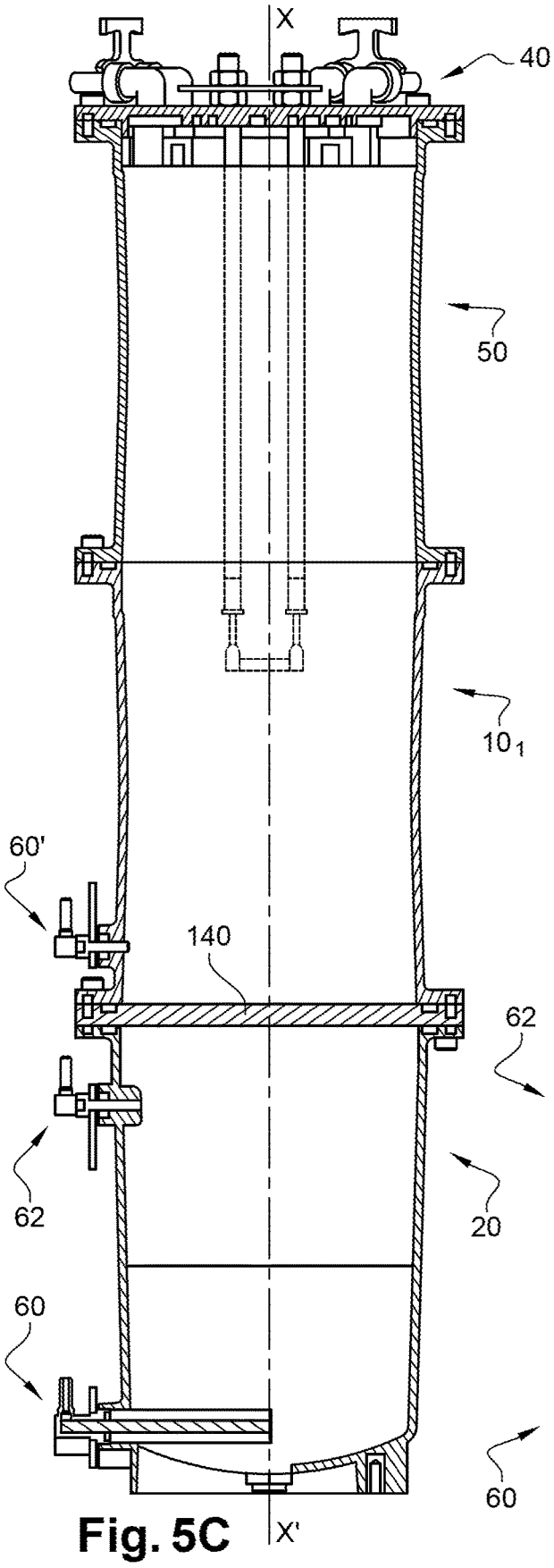
Figure 5D:
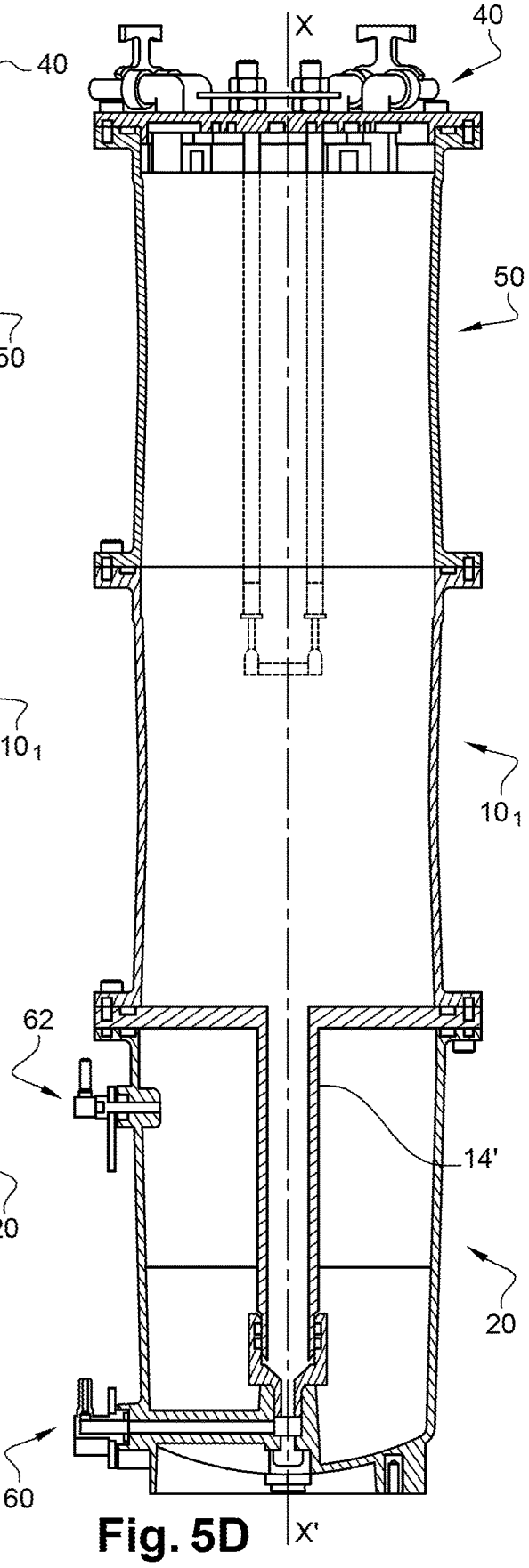

As a variant, and as illustrated in FIGS. 5C and 5D, it is possible to use a compartment 10' without a lower part $\mathbf{10}_2$ (FIG. 5C) the lower part $\mathbf{10}_2$ of which (FIG. 5D) is not conical or its section does not become narrower or smaller; in other words, the volume can be adjusted with a structure of stacked compartments, the $1^{st}$ compartment 10' not necessarily having the structure shown in FIG. 2A or 2C.

Thus, in FIG. 5C, the $1^{st}$ compartment 10' is not inserted in the $2^{nd}$ compartment 20 and is even separated from it by a wall 140 approximately perpendicular to the extension axis XX' and/or to the vertical at the location when the device is in the usage position. In this embodiment, the $1^{st}$ compartment 10' does not have a $2^{nd}$ part like the part $\mathbf{10}_2$ of the preceding embodiments.

Means 60' (identical or similar to means 60 described above) can be provided at the bottom of the wall of this $1^{st}$ compartment:

- to bring a $1^{st}$ liquid (for example ink) to its upper part (for stirring), for example by means of the cover 40 or laterally, by a hydraulic connector such as connector 4200 (FIG. 2B) made along the wall of the compartment 50 (introduction of liquid from the bottom of the compartment 10, 10', has already been described above);
- and/or to draw off a liquid, for example ink, and to send it for example to a print head.

Means 60 (already described above) may be provided at the bottom of the wall of the $2^{nd}$ compartment:

- to draw off a $2^{nd}$ liquid to bring it to the top part of the $1^{st}$ compartment and/or send it to a print head;
- and/or to introduce a liquid into the same $2^{nd}$ compartment.

As a variant, in FIG. 5D, the $1^{st}$ compartment has a $2^{nd}$ part $\mathbf{10}_2$, but its structure is not conical, it is provided with a conduit 14' starting from its lower part, or from its bottom wall 140', that is approximately perpendicular to the XX' extension axis and/or to the vertical at the location when the device is in its usage position. The cross-section of this conduit for example remains constant as it passes through the lower compartment 20 and joins the means 17, 19, 28, 60 described above with reference to FIGS. 2A-2B or, according to the variant mentioned above, a seal such that the connection between the compartments 10' and 20 is leaktight, through its flow orifice 151'.

Figure 5E:
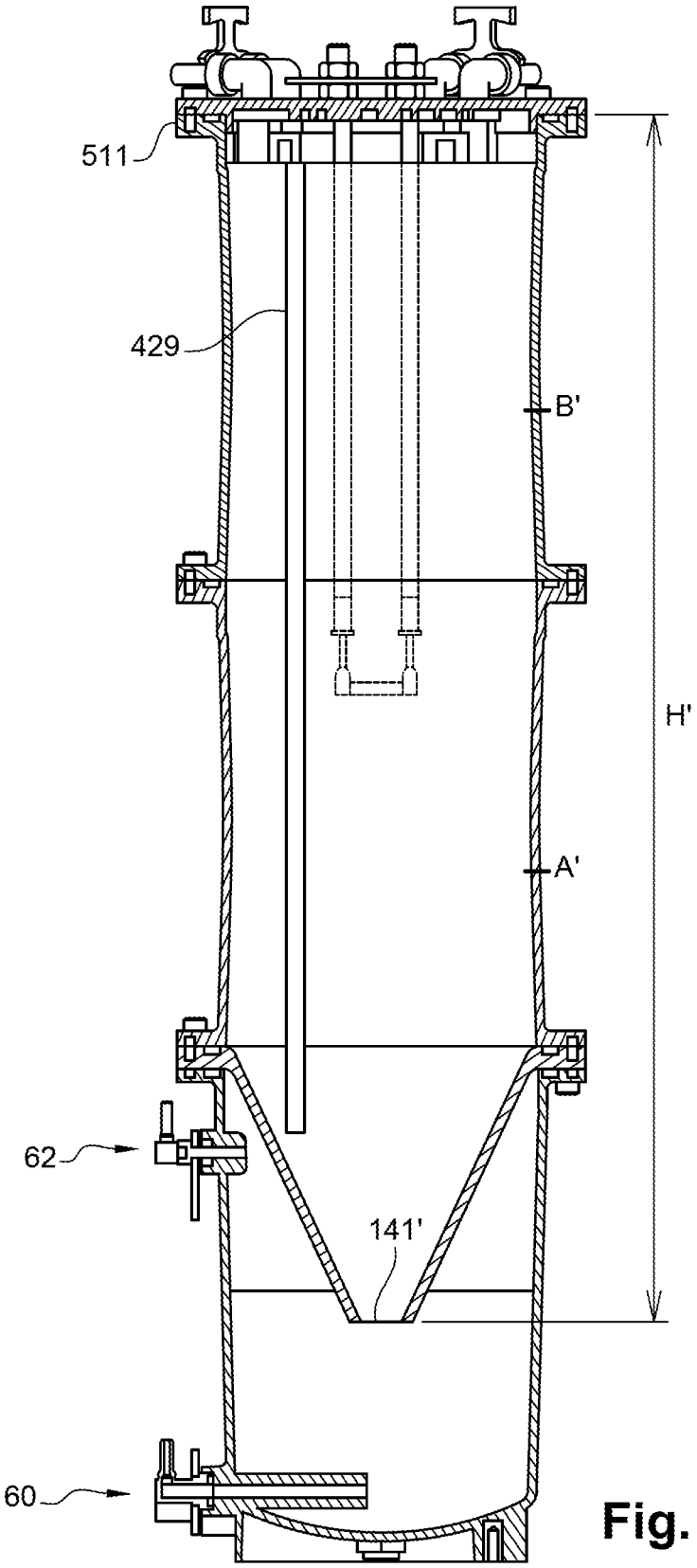

In these variants in FIGS. 5C-5E:

- means 62, like those already described above, may be provided to balance the pressure between the lower and the upper compartments of the reservoir;
- the inner volume of the lower compartment 20 is increased;
- the upper compartment of the reservoir may or may not contain an extension volume 50; in other words, these variants may be applied to structures like those in FIGS. 2A-3, without an extension volume 50.

Another example variant of a reservoir to which the invention can be applied is illustrated on FIG. 5E.

In this other example, as in FIG. 5B, the reservoir comprises two compartments 10, 20 superposed one on the other when they are in the assembled position as illustrated in FIG. 5B, and the $1^{st}$ part $\mathbf{10}_1$ of the first compartment 10 is prolonged by an extension volume 50.

But liquid from the $1^{st}$ compartment is drawn off using a conduit or a pipe 429 that is immersed in this $1^{st}$ compartment and that brings this liquid by pumping towards the outside of the reservoir through the cover 40 (or to a connector 62' or 60 located along the reservoir 10 (as explained above with reference to FIG. 2F or FIG. 12C).

In this case, there is no longer a need to have all the means 15, 17, 17$_1$, 26, 60$_3$to bring the liquid flow from the 1$^{st}$ compartment, as in FIG. 5B. The end 141' of the 2$^{nd}$ part furthest from the 1$^{st}$ part can be closed, as can be seen on FIG. 5E.

The other advantages presented above are kept.

Ink (or liquid) can be drawn off as described in application EP 2298123, through a conduit arranged so as to draw off ink in a median zone of the 1$^{st}$ compartment, for example located between:

- a first level A', defined by a level located at not less than 1/20$^{th}$ or 1/10$^{th}$ or 1/4 or 1/3 of the height of the 1$^{st}$ compartment (including volume 50), measured from its lowest point 141', as a proportion of the height H of the 1$^{st}$ compartment (itself measured between the lowest point 141' and the highest point of the 1$^{st}$ compartment at the top of the volume 50, when the 1$^{st}$ compartment is in operation),
- and a second level B' defined by the upper third or quarter (once again measured as a proportion of the height H' of the reservoir, as explained above).

In this median zone, between levels A' and B', the concentration of a pigmented ink remains approximately constant and equal to the initial nominal concentration.

In the embodiments described with reference to FIGS. 5A-5E, the length of the level measurement rods is adapted; they can be longer than the structures in FIGS. 2A-4B.

In the context of use in an inkjet printer, the upper reservoir composed of compartments 10 or 10' (including an extension volume 50) of the embodiments described with reference to FIGS. 5A-5E, can be used as an ink reservoir, while the second compartment 20 is then used as a solvent reservoir, the two being assembled to be leaktight relative to each other.

As a variant, in an inkjet printer, the upper reservoir composed of compartments 10 or 10' (including an extension volume 50) can be used as a solvent reservoir, while the second compartment 20 is then used as an ink reservoir, the two being assembled to be leaktight relative to each other. This means that solvent can be topped up by gravity.

A reservoir like that described above with reference to FIGS. 5A-5E can be used by the circuit as described above with reference to FIG. 4A, or as a variant, to FIG. 4B, this circuit possibly being adapted depending on the various configurations of the reservoir.

Consequently, as can be understood from FIGS. 5A-5E, according to one embodiment, the invention can be applied to a reservoir for an inkjet printer, comprising:

- a 1$^{st}$ compartment, comprising at least one 1$^{st}$ part and a removable extension volume;
- a 2$^{nd}$ compartment, delimited by a lateral wall, the 1$^{st}$ part being included between the removable extension volume and the 2$^{nd}$ compartment, when the 2 compartments and the removable extension volume are assembled to each other.
- 1$^{st}$ means of drawing off a liquid in the 1$^{st}$ compartment, and 2$^{nd}$ means of drawing off a liquid in the 2$^{nd}$ compartment;
- a cover to close the 1$^{st}$ compartment.

The 1$^{st}$ compartment of this reservoir:

- can be separated from the 2$^{nd}$ compartment by a wall located between the 1$^{st}$ compartment and the 2$^{nd}$ compartment, when the 2 compartments are assembled to each other;
- or may comprise a 2$^{nd}$ part, called the lower part or a part that is located in the 2$^{nd}$ compartment, the wall of which surrounds it in the radial direction when these 2 compartments are assembled to each other.

This 2$^{nd}$ lower part may include a straight part that becomes narrower or smaller as the distance from the 1$^{st}$ part increases. This 2$^{nd}$ lower part may be closed at its point furthest from the 1$^{st}$ part.

The 1$^{st}$ drawing off means may comprise at least one conduit that extends in the volume of the 1$^{st}$ compartment, starting from the cover or that passes through the lateral wall of the 1$^{st}$ compartment.

The 2$^{nd}$ drawing off means may comprise at least one conduit that extends in the volume of the 2$^{nd}$ compartment, starting from the cover or that passes through the lateral wall of the 2$^{nd}$ compartment.

Figure 6A:
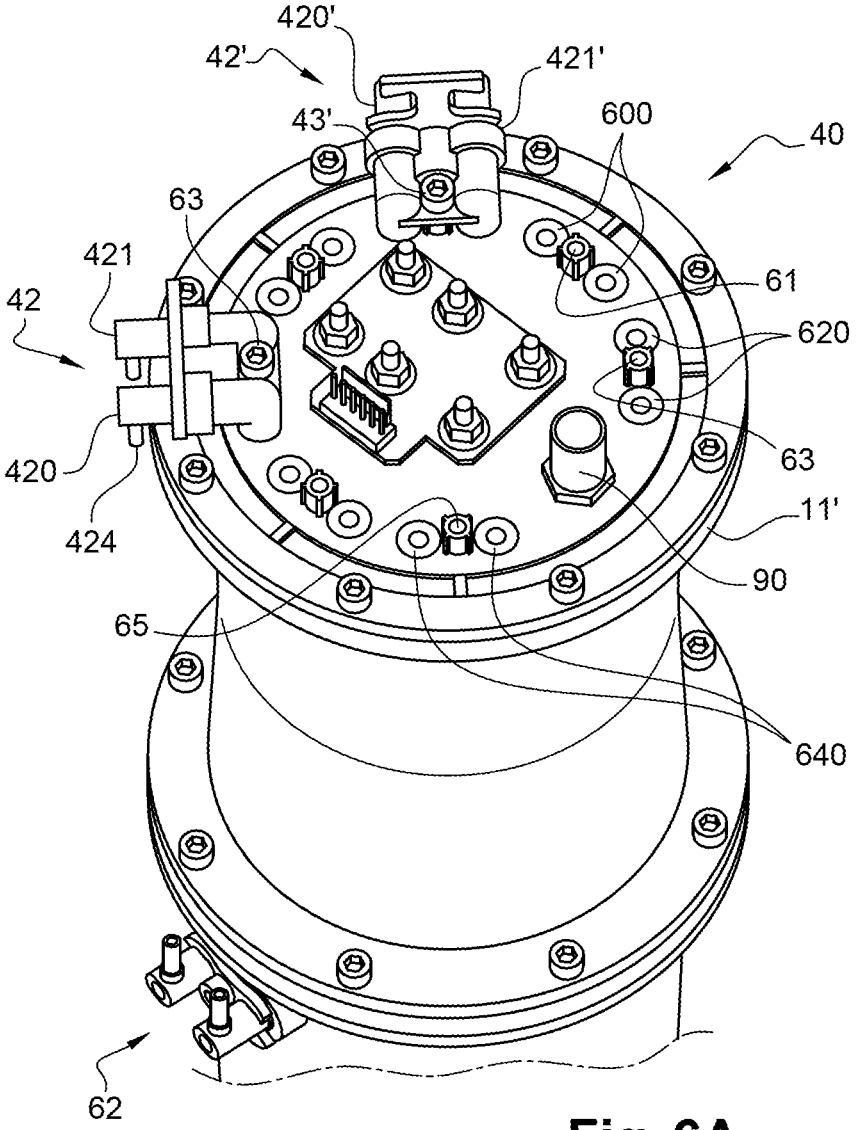
FIG. 6A represents an example embodiment of a cover according to the invention.
Figure 6B:
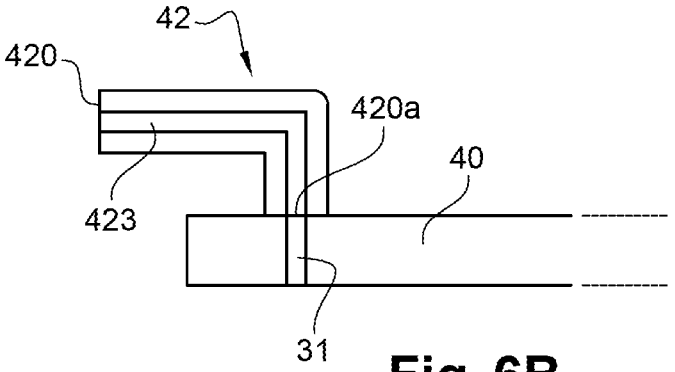
FIG. 6B represents one aspect of an embodiment of a cover according to the invention.

FIGS. 6A-6B represent an example of the fabrication of a cover 40 according to the invention that in particular can be used in combination with the reservoir structures described above.

The upper part of this cover is provided with one or several fluid connection means 42, 42', each comprising at least one inner conduit that can guide a liquid from at least one inlet 420, 421, 420', 421', towards at least one conduit 31 that passes through the cover. Screws can be seen on this embodiment that are used to fix the cover by screwing it onto the flange 11' of the 1$^{st}$ compartment or 511 of the extension volume 50, and also screws that screw the flanges 11 and 21.

FIG. 6B is a diagrammatic sectional view of one of these fluid connection means 42 with its inner conduit bend 423 that, in this example, is for guiding a fluid as it flows from the inlet 420 of the fluid connection means to a conduit 31 that passes through the cover 40; this conduit 31 is used to pour this fluid into the compartment 10, possibly through an ejector as described below. In the embodiment illustrated in FIG. 6B, such an ejector is not used on the lower surface of the cover, the conduit 31 then opening up directly into the reservoir when there is a cover 40 on the reservoir.

The inlet 420 of the means 42 may be fitted with a connector, for example a "firtree" connector, that makes it easier to connect an external conduit to the internal conduit 423. In the view shown in FIG. 6A, such a connector 424 faces a direction approximately perpendicular to the plane defined by the cover 40, which facilitates circulation of a fluid, for example ink, that is brought from the bottom of the reservoir to the conduits 423, 31 (FIG. 6B).

The structure of the fluid connection means 42' is identical or similar to the structure of the means 42 that have just been described.

As a variant, it is possible to use a cover structure like that described in document EP 3124254, in combination with one or the other of the reservoir structures described above.

Such a structure, regardless of whether it is the structure presented with reference to FIGS. 6A-6B or the structure described in document EP 3124254, can be further improved by making it modular: for example, each of the connectors 42, 42' in FIG. 6A can be movable relative to the cover 40 and can be positioned at different positions on it.

To achieve this, additional orifices 600, 620, 640 can be provided on the upper part of the cover 40, to position one of the two connectors 42, 42' depending on the user's needs and the geometry of the environment in which the cover and the corresponding reservoir are used. FIGS. 6A, represents 7 possible positions (any other number of positions is possible) at which each of the connectors 42, 42' can be placed on the upper part of the cover 40 (two of them are used in this example). Conduits can pass through the cover 40 itself (these conduits may or may not open up depending on requirements) and these conduits may be identical or similar to the conduit 31 in FIG. 6B, and that are located along the prolongation of the orifices 600, 620, 640.

As a variant, instead of the additional orifices, each of which is prolonged by a conduit, it is possible to provide only one or more locations (or "patterns") that can be marked or identified, for example by starting drilling, so that one or more through conduits 31 can be made later so as to position one or more connectors in a future configuration. Therefore one or more locations that is/are intended to be occupied by one or more connectors 42, 42', is/are facing one or several through conduits 31, while one or more positions not yet used do not comprise a through conduit 31 but is/are identified to make at least one through hole and to position one or more connectors.

Also as a variant, one or several additional orifices can be closed off by a plug as long as it is not used for a connector.

Means 43, 43' are also provided to hold or secure each connector 42, 42' fixed relative to the cover in the chosen position: thus, screws 43, 43' that cooperate with threaded or tapped holes 61, 63, 65, are for holding or securing the corresponding connector where the user installed it, then releasing this connector and possibly repositioning it elsewhere on the cover. Means 61, 65 can also be provided in the position(s) not yet provided with a connector: if a connector has to be positioned, one or more conduit drillings 31 are made and a connector can be positioned and fixed, the holding or securing means already being available or present. The same applies for any additional orifice closed off by one or two plugs, as long as it is not used for a connector: securing or holding means can be already available or present for any connector positioned on this orifice, once the plug(s) is/are removed.

Other securing means can be used to hold or secure each connector 42, 42' fixed relative to the cover in the chosen position; alternatives to the above mentioned screws are for example one or more quarter turn fastener or one or more clamp collar or one or more clips nut and the respective corresponding means if needed on the cover. All these means are removable.

Figure 7A:
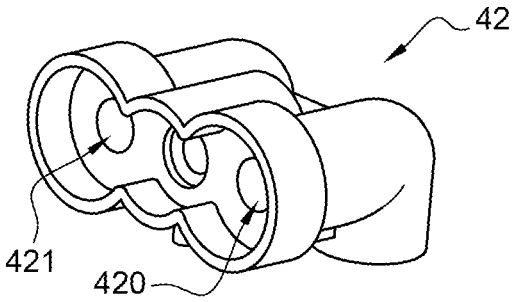
FIGS. 7A-7B, 8, and 9A-9B represent removable elements of an example embodiment of a cover according to the invention.
Figure 7B:
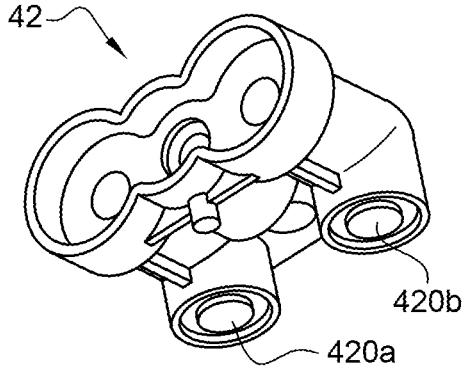

FIGS. 7A and 7B represent other detailed views of a removable connector 42. This connector has two parallel internal conduits that an bring fluids circulating in them to 2 outlets 420*a*, 420*b*, that will be positioned against the corresponding orifices 600, 620, 640 of the cover.

As a variant, such a connector can:

- have only one conduit 423 between an inlet 420 and the corresponding outlet 420*a;*
- or have more than 2 conduits, preferably parallel to each other, each connecting an inlet (such as inlet 420) and the corresponding outlet (such as the outlet 420*a*).

Figure 8:
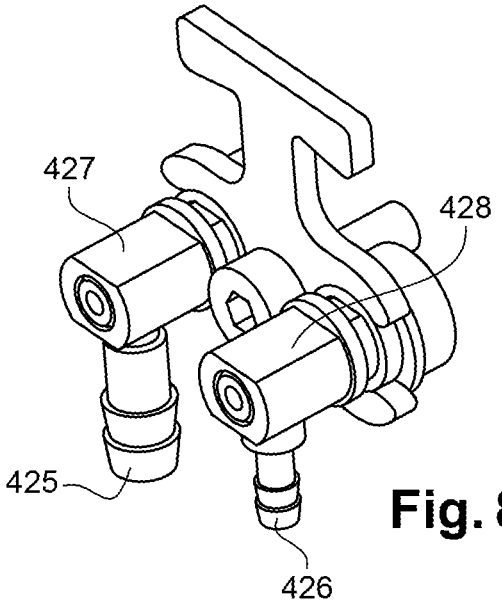

FIG. 8 represents an example of adapters 427, 428 that can be positioned at the inlets of a connector such as connector 42, so as to facilitate placement of one or 2 conduits at this inlet, for example using fittings 425, 426, that in particular may be of the "firtree" type. Once again, a set of adapters can be made as a function of the number of conduits in the connector 42.

Conduits such as conduit 31 can open up directly in the reservoir.

As a variant, fluid injected by a connector 42, 42' and then by a conduit such as conduit 31 can firstly be sent into a chamber (or ejector) of the type described in document EP 3124254.

The modularity of a cover structure according to the invention can also depend on the removable nature of such chambers (or ejectors) arranged on the lower surface of the cover.

Figure 9A:
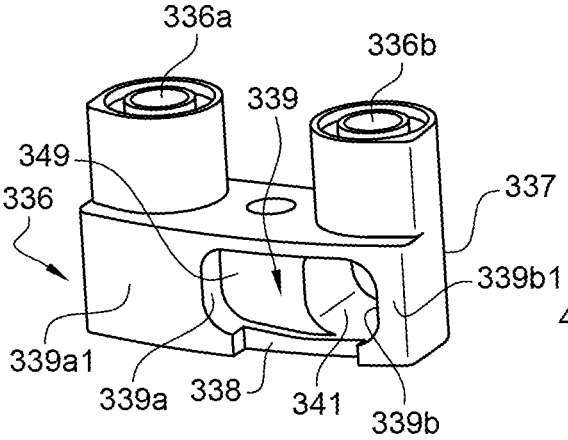
Figure 9B:
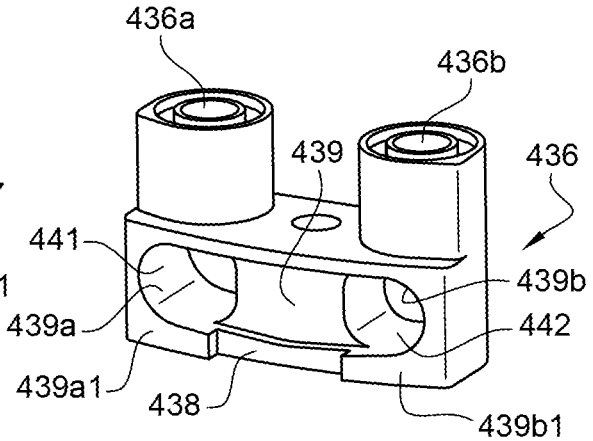

Thus FIGS. 9A-9B represent an example embodiment of chambers of the type described in EP 3124254, but in this case these chambers are removable.

In the same way as adaptable positioning of connectors 42, 42' was described on the upper surface of the cover 40, it is therefore possible to removably position one or more chamber(s) (or ejector(s)) like the chambers 336, 436 on FIGS. 9A and 9B, in a modular manner, at different positions on the lower surface of the cover. However it should be noted that for some applications, one or several connectors 42, 42' is/are positioned on the upper surface of the cover 40, while no chamber and no ejector is positioned on the lower surface of the cover.

In chamber 336 in FIG. 9A, a single outlet orifice 341 is a through orifice (the other is blocked), while chamber 436 in FIG. 9B comprises 2 outlet orifices 441, 442 each of which is a through orifice. As explained in EP 3124254, these outlet orifices are used to project fluid that flows from the cover 40 at least partly to the lateral wall of the reservoir (the orientation of the conduit in the chamber can be variable: it can be such that the fluid is sprayed at 90° against the wall of the reservoir or at an angle of less than 90°, for example between 30° and 70°).

Each of these chambers comprises one or several pads 336*a*, 336*b*, 436*a*, 436*b* in its upper part, that will be positioned in contact with one or several outlet orifice(s) of one or several tubes or conduits that pass through the cover 40. Each of these pads usually comprises an inlet orifice of a conduit that passes through the chamber—with the required orientation—to bring in a fluid that circulates in it to one of the orifices 341, 441, 442. In the special case of the structure in FIG. 9A, the orifice associated with the pad 336*a* is closed off by a closing element (or means), preferably removable, for example a pellet with a size adapted to the orifice to be closed off.

In a more detailed manner, and according to the illustrated embodiments, the removable ejectors 336 and 436 comprise a bent conduit with a first part 336*b*1 (visible on FIG. 11A), that is prolonged by a second part 336*b*2 (see also on FIG. 11A), that forms a bend with the first part. The conduit 336*b*2 opens up in a chamber, or cavity 339 or 439 through openings 341, and 441, 442 respectively (FIGS. 9A, 9B). This chamber 339 or 439 respectively, can be made in a portion of the ejector that, when it is positioned in contact with the lower part 433*b* of the cover, partly projects from it.

Chambers 339 and 439 are delimited by an internal surface that in the illustrated embodiment comprises lateral walls 339*a*, 339*b*, and 439*a*, 439*b* respectively.

Front faces 339*a*1, 339*b*1 and 439*a*1, 439*b*1 define a bearing surface of the ejector; it bears in contact with the internal wall of the reservoir when the reservoir is closed by the cover 40; these faces can advantageously have a curvature that corresponds to an internal surface of the reservoir. Walls 349 and 449 in which openings 341 and 441, 442 respectively are made delimit the bottom of the cavity.

Chambers 339 and 439 also comprise flow means 338 and 438 respectively, for example at least one slit or at least one outlet orifice, in the lower part of the chamber. According to one embodiment, these means face an upper wall (visible on FIG. 11A) of the chamber. These flow means will enable fluid that penetrated into chambers 339 and 439 to flow along the inner wall of the 1$^{st}$ compartment (regardless of whether it is that of the 1$^{st}$ part or that of the extension volume 50). Preferably, these flow means provide an area equal to or larger than the area of the orifice 341, or of the sum of the areas of the orifices 441, 442 respectively. This condition assures that the chamber 339 cannot retain liquid, which would restrict flow of this liquid to the reservoir. The cavities 339 and 439 advantageously have a sufficiently large volume so that they are not saturated and so that the fluid does not overflow laterally. As for the connectors, an ejector can:

only have a single conduit between an inlet 336*a*, 336*b*, 436*a*, 436*b* and the corresponding outlet;

or have more than 2 conduits, preferably parallel to each other, each connecting an inlet (such as inlet 336*a*, 336*b*, 436*a*, or 436*b*) and the corresponding outlet (such as outlet 341, 441, or 442).

Figure 10A:
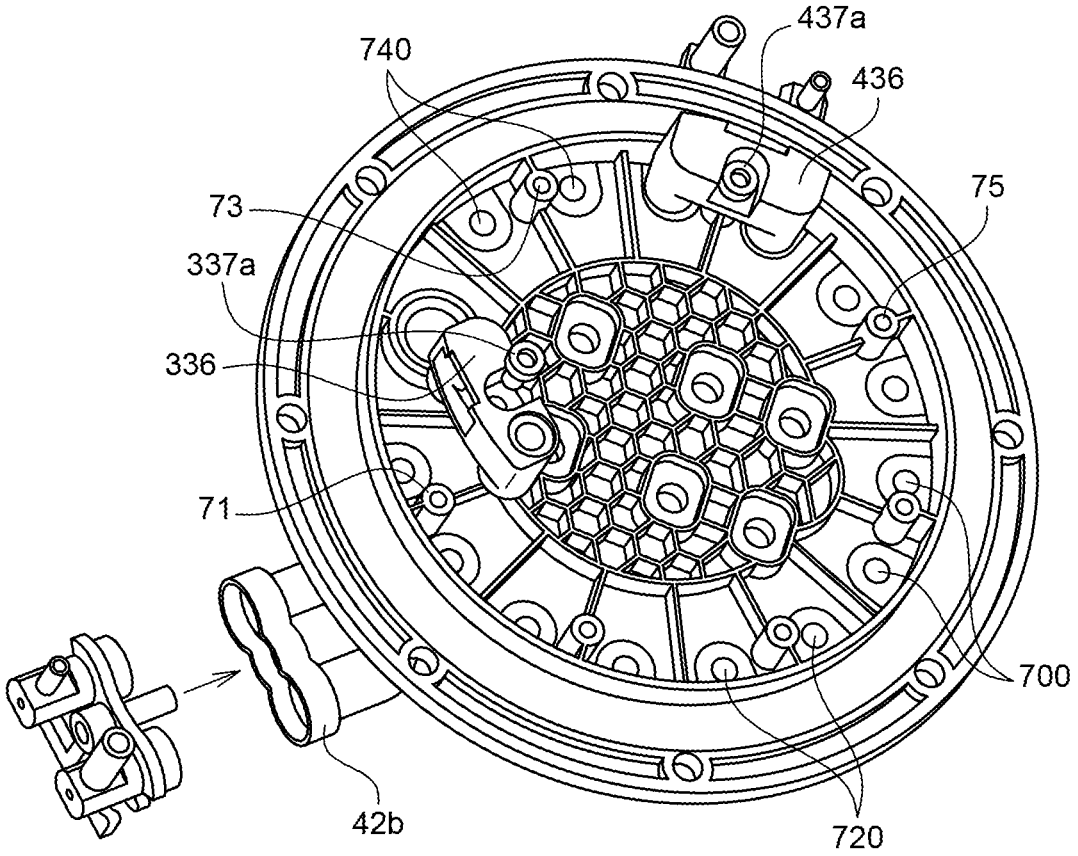
FIGS. 10A and 10B represent steps in the assembly of one example embodiment of a cover according to the invention.

As illustrated in more detail in FIG. 10A, the lower surface of the cover 40 is provided with orifices 700, 720, 740 that will be used to position one or the other of the ejectors 336, 436. Conduits pass through the cover 40 itself, and these conduits may be identical or similar to the conduit 31 in FIG. 6B, and are located along the prolongation of the orifices 700, 720, 740. Orifices 600, 620, 640 in the upper part of the cover may also correspond to the latter, as described above.

Each of the ejectors 336, 436 in FIG. 10A can be movable relative to the cover 40 and can be placed at different positions under the cover.

Means 337*a*, 437*a*, 71, 73, 75 can also be provided to hold each ejector 336, 436 fixed relative to the cover, in the chosen position.

FIG. 10A shows a bottom view of the cover 40 in which an ejector 436 has already been positioned in contact with the lower surface of the cover 40 and an ejector 336 will be put into position in contact with this same lower surface. Means 71, 73, 75 are also provided to hold each ejector 336, 436 in a fixed position relative to the cover: thus, screws 337*a*, 437*a*, that cooperate for example with tapped holes 71, 73, 75, make it possible to hold the corresponding ejector where the user installed it, then to release this ejector and possibly reposition it elsewhere on the lower surface of the cover. The device is thus modular.

As a variant, instead of the additional orifices, each of which is prolonged by a conduit, it is possible to provide one or several locations (or "patterns") that can be marked or identified, for example by starting drilling, so that one or more through conduits 31 can be made later so as to position a connector in a future configuration. Therefore one or more locations that is/are intended to be occupied by one or more connectors 336, 436, is/are facing one or several through conduits 31, while one or more slots not yet used do not comprise a through conduit 31 but is/are identified to make a through hole and to position one or more connectors. Also as a variant, one or several additional orifices can be closed off by a plug as long as it is not used for a connector.

Means 73, 75 can also be provided in one or more of the position(s) not yet provided with a connector. If one or more connector(s) has/have to be positioned, one or more conduit drilling(s) 31 is/are made and one or more connector(s) can be positioned and fixed, the holding or securing means already being available or present. The same applies for any additional orifice closed off by one or two plugs, as long as it is not used for a connector: holding or securing means can be already present for any connector that will be positioned on this orifice, once the plug(s) is/are removed.

Other securing means can be used to hold or secure each connector or ejector 336, 436 fixed relative to the cover in the chosen position; alternatives to the above mentioned screws are for example one or more quarter turn fastener or one or more clamp collar or one or more clips nut and the respective corresponding means if needed on the cover. All these means are removable.

Figure 10B:
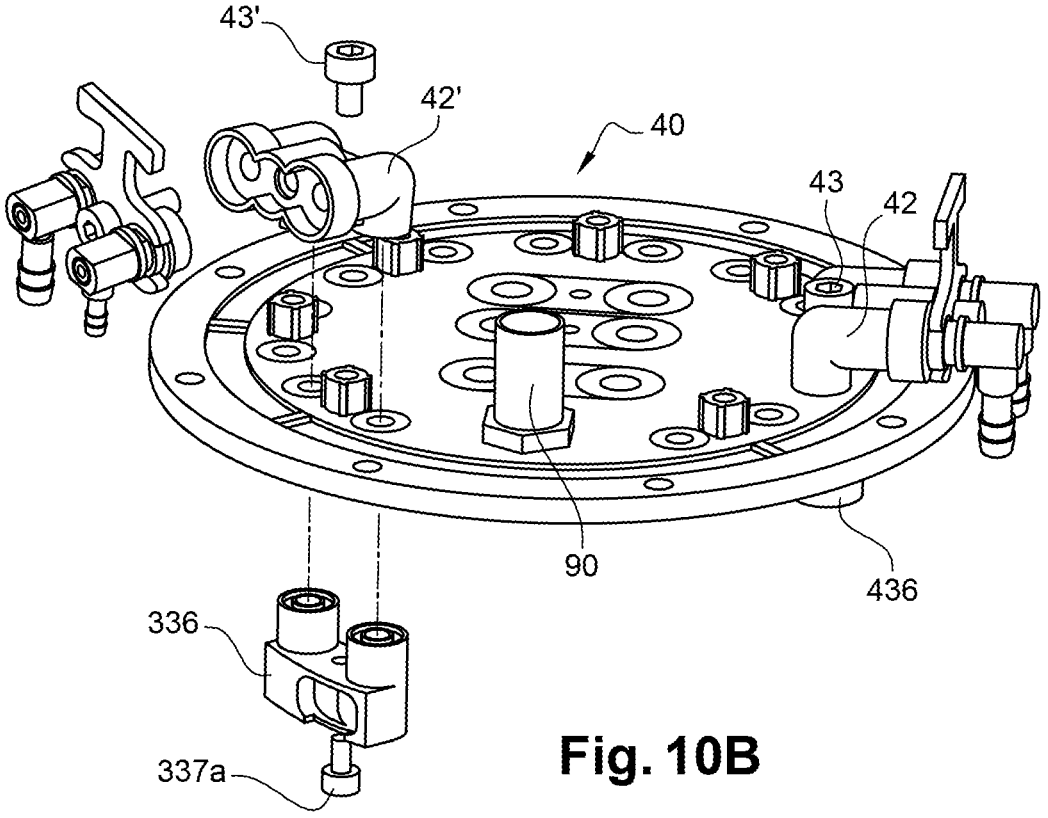

FIG. 10B shows a top view of the cover 40, in which a connector 42 is already mounted on the upper surface, while the other 42' will be mounted; similarly, as can be seen in FIG. 10A, one ejector 436 is already positioned on the lower surface, while the other 336 will be mounted to correspond to the connector 42' of the upper surface. As already explained above (FIG. 6A) means 43, 43' are also provided to hold or secure each connector 42, 42' in a fixed position relative to the cover.

Figure 11B:
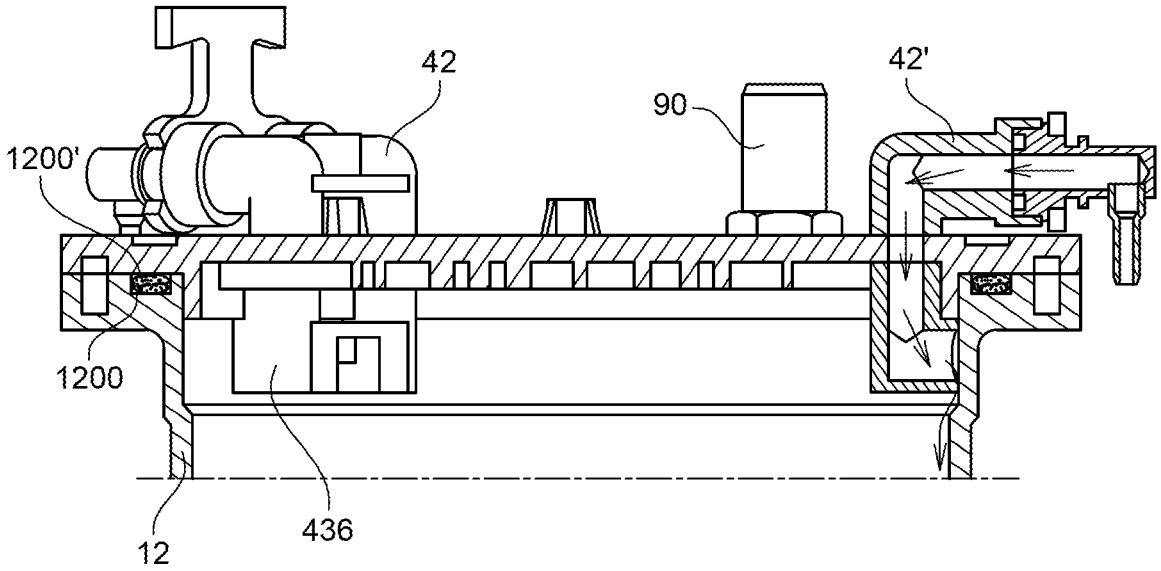
Figure 12:
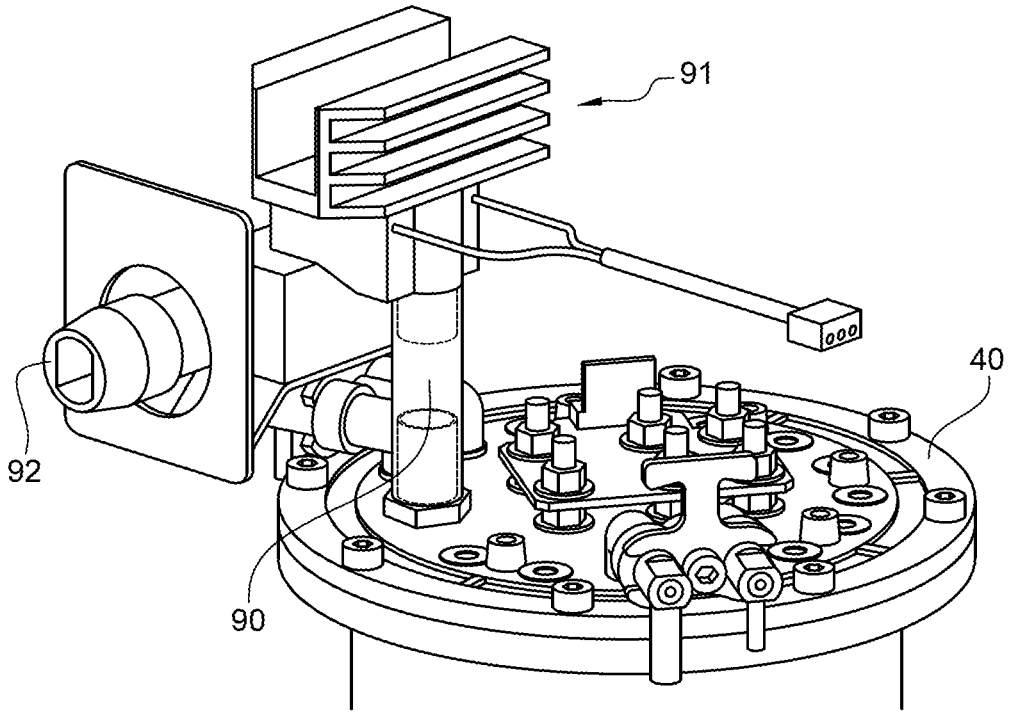
FIG. 12 represents another aspect of an embodiment of a cover according to the invention, with a condenser element.

FIGS. 11A and 11B represent sectional views of a cover provided with two removable fluid connectors 42, 42' in its upper part, and with two removable ejectors 336, 436 in its lower part.

This cover extends between an upper surface $\mathbf{433}_1$ and a lower surface $\mathbf{433}_2$. In the illustrated embodiment, these two surfaces are approximately parallel to each other in a ZY plane. By definition, the X direction is the direction perpendicular to this plane.

A first part 433*a* called the upper part will bear on top of the wall 12 (or the lateral wall of the volume 50) of the reservoir, as shown diagrammatically on FIG. 11B. This shape of this first part 433*a* in the ZY plane is approximately circular.

The external shape of the second part 433*b* called the lower part is adapted to the inner shape of the reservoir that the cover will close. For example, if this outer shape is cylindrical, then this second part 433*b* will preferably be in the form of a circular ring. Its outside dimensions are adapted to the internal shape of the reservoir, for example with an outside diameter D approximately equal to the inside diameter of the reservoir or compartment on which the cover will be positioned, to close it. Its lateral edge defines a straight cylindrical surface $S_e$ or forms part of a straight cylindrical surface $S_e$, that corresponds to the inner wall of the reservoir, when the reservoir is closed by the cover 40. The cylindrical surface extends parallel to a X axis that will be the vertical axis when the cover is placed on the reservoir, the last one being in its vertical usage position. This second part 433*b* will be introduced into the upper part of the reservoir. Means can be provided to make a leaktight seal between the inner wall of the reservoir and the first part 433*a* and/or the second part 433*b*; for example a peripheral groove 1200 (represented on FIG. 11B) will contain a seal 1200' at the interface between the first part 433*a* and the reservoir.

The conduit 31 passes through at least part of the cover, and it is preferably positioned in a part close to the outer edge of the cover. This conduit, together with an ejector 336, 436, causes the fluid to flow from the upper part 433*a* of the cover to the surface $S_e$, in fact towards the internal wall of the reservoir when the cover 40 is in position on the reservoir. The fluid flows along the internal wall under the action of the pump of the circuit in which it circulates, but also under the action of gravity. As a variant (not shown), an ejector is not used at the outlet from the conduit 31, therefore the fluid exits directly into the volume of the reservoir or through a connector and a conduit to be directed to the bottom of the reservoir without flowing along the internal wall.

The structure of the removable ejectors 336, 436 has been described above with reference to FIGS. 7A, 7B.

According to the embodiment illustrated on FIG. 11A, the removable ejector 336 comprises a bent conduit comprising a first part 336*b*1, that extends along a direction approximately perpendicular to the ZY plane of the cover (or parallel to the surface $S_e$ or to the Z axis). The other elements of the ejector (second part 336*b*2, or cavity 339, opening 341) have been presented above. The chamber 339 can be made in a portion of the ejector that prolongs the circular ring 433*b* under the lower portion $\mathbf{433}_2$, on a part of its periphery. Furthermore, this cavity that faces the surface $S_e$, is intended to face the wall 12 when the cover 40 is installed at the top of the reservoir.

The chamber 339 is delimited by an inner surface that, in the embodiment illustrated, comprises lateral walls 339*a*, 339*b*, the front face 339*a*1, 339*b*1 of which is held in contact with or bearing on the surface $S_e$ and bears in contact with the internal wall of the reservoir when the reservoir is closed by the cover 40; advantageously, the curvature of these front faces 339*a*1, 339*b*1 corresponds to the inner surface of the reservoir. Therefore the chamber is open in or on the surface $S_e$ or the internal wall of the reservoir that will close it laterally. A seal (not shown in the figures) may possibly be placed between these front faces 339*a*1, 339*b*1 and the internal surface of the reservoir. The wall 349, in which the opening 341 is made and that delimits the bottom of the cavity, faces the surface $S_e$ (and the internal wall of the reservoir when the reservoir is closed by the cover 40).

As explained above, the fluid flow means 338 will enable fluid that will penetrate into the chamber 339, to flow along the wall 12.

The conduit 336*b*2 can direct liquid to the surface $S_e$ and to the internal wall of the reservoir when the reservoir is closed by the cover 40, preferably under the leak tightness means when they are present and/or at least partly underneath a level defined by the lower surface of the cover (for example the ZY plane). The chamber 339 is used to confine the liquid that will be directed towards the internal wall and then through its outlet means to guide it to the bottom of the reservoir (or along a direction away from the upper surface $\mathbf{433}_1$).

In FIGS. 11A and 11B, the conduit 336*b*2 brings the fluid towards the cavity 339 along a direction perpendicular to the surface Se. But preferably, the conduit 336*b*2 brings the fluid towards the cavity 339 along a direction inclined towards this surface and towards the means 338. This inclination is a compromise between the fact of not splashing the wall and the constraint of limiting the length of the conduit (and therefore the necessary material and the work necessary to make it). For example, this inclination is about 45° relative to the ZY plane (or relative to the surface Se or to the X axis) or, more generally, is at an angle of between 30° and 60° or even between 0° and 90° (relative to the ZY plane or to the surface Se or to the X axis).

The description that was given above is also applicable to the fabrication of a chamber or an ejector 436 (FIG. 9B), comprising two conduits that open up in the chamber 439 through the openings 441, 442.

As explained in document EP 3124254, the outlet orifice (s) 338, 438 from the ejectors cooperate with the internal wall of the reservoir when the cover is mounted on the reservoir: thus, the fluid flow to the connector 42 and then through the ejector 336 is indicated in FIG. 11B by an arrow and it can be seen that is directed towards the wall of the reservoir and then flows along this wall. In the case of the ejector 436, the two liquids that are injected are mixed in the mixing chamber 439 (FIG. 9B) before flowing through means 438 along the wall of the reservoir.

Consequently, according to one aspect of the invention, one or several fluid connectors can be positioned removably, for example at least one of them in different positions, in the upper part of the cover; adapted means are provided in the upper part of the cover, to position this/these fluid connector (s), which can be used in combination with one or more removable connector(s), for example "firtree" connectors, and/or one or several mixing chambers (or "ejectors") can be positioned removably, for example at least one of them in different positions, in the lower part of the cover; suitable means are provided in the lower part of the cover to position this/these mixing chamber(s) or ejector(s) Therefore the cover is completely modular.

A method of configuring a cover as described above may for example include disassembling one or more connection element(s) (upper and/or lower) from one or more given connection position(s) on (and/or under) the cover, and repositioning it/them in at least one other given connection position(s) on (and/or under) the cover. Preferably, the different possible positions of the lower/upper connector(s) are at a constant distance from the edge of the cover.

Also preferably, the shape of the cover is circular, the different possible positions of the lower/upper connector(s) for example being at a constant distance from the edge of the cover. The connector(s) can then be positioned at different positions on a circle, on the upper surface or the lower surface of the cover.

Regardless of which embodiment is adopted for the cover, means may be provided in the upper part so that a separator or condenser element 91 can be positioned removably, for example a Peltier type cell. Thus, a conduit 90 can be seen on FIGS. 6A, 10B, 11A, 11B to which such a separator element 81 can be attached, like that shown for example in FIG. 12. This element 91 is for condensing solvent vapours contained in the atmosphere located above the liquid, for example in the compartment 10 in the case of a reservoir like that described above with reference to FIGS. 2A-5E. Condensate drops then return into the reservoir, through the conduit 90. Air is evacuated after condensation through another conduit 92.

It will also be remembered that the cover can be provided with orifices to hold level measurement rods 421, 422 (see FIGS. 2A, 5B-5E) for example of the type described in application EP 3134254.

The modular cover according to the invention, with one or several removable connectors and/or one or several removable ejectors can be applied to reservoir structures described with reference to FIGS. 2A-5E; it is also applicable to reservoir structures described for example in document EP 3124254, or to any reservoir of an industrial inkjet printer for which there is a need to introduce one or several fluids through its upper part.

Printers to which the invention can be applied are particularly industrial printers, for example of the type that can print on non-plane surfaces, for example on cables or bottles or cans or more generally containers, for example of the type with a curvature or a curved surface, in particular boxes or drums or pots. According to another aspect related to such printers, the distance between the print head and the print support is larger than the distance on usual office printers. For example, this distance is equal to at least 4 mm or 5 mm for a CIJ printer.

Another aspect of these printers is their print speed: their maximum print speed can be between 5 and 15 m/s, or even 20 m/s or more.

Another aspect of these printers is their ability to print on very different surfaces, for example on glass or on metal or on blisters or packaging materials.

A print method can use a device and particularly a reservoir according to the invention.

In particular, when printing on a print support 800 using a print head 1:

ink and/or solvent can be injected into a reservoir according to the invention;

and/or ink can be sent from a reservoir according to the invention to the print head;

and/or ink used for printing can be recovered from the print head and sent to a reservoir according to the invention;

and/or ink can be drawn off in a lower part of a reservoir according to the invention and be sent to the upper part of this reservoir.

These different steps can be used for example making use of the circuit described with reference to one of FIGS. 4A-4B.

The invention claimed is:

1. A reservoir cover for a continuous inkjet printer, the cover comprising:

an upper surface;

a lower surface;

an upper part and a lower part of the cover between the upper surface and lower surface, at least said lower part of the cover being delimited laterally by a peripheral surface;

at least one through conduit that passes through at least part of the cover to bring at least one liquid from said upper part to said lower part, at least one $1^{st}$ liquid connector, capable of being positioned removably relative to the upper surface of the cover, at different positions on this upper surface, said $1^{st}$ liquid connector comprising at least one inner conduit to bring at least one liquid to an inlet of said through conduit, that passes through at least part of the cover; and means for maintaining said $1^{st}$ liquid connector fixed relative to the cover, in one of said positions, wherein the upper surface of the cover comprises one or several patterns, each being prolonged by a conduit passing through at least part of the cover to bring a liquid in from said upper part to said lower part or identifying the position of a through conduit to be made, one or several of said plurality of patterns defining one or several positions at which the $1^{st}$ liquid connector is adapted to be positioned and fixed using said means for maintaining said $1^{st}$ liquid connector fixed relative to the cover.

2. The reservoir cover according to claim 1, comprising a plurality of through conduits, each passing through at least part of the cover to bring a liquid from said upper part to said lower part of the cover.

3. The reservoir cover according to claim 1, also comprising an evacuation conduit on the upper part of the cover and at least one condenser element that can be fixed on or to this evacuation conduit.

4. A reservoir of a continuous inkjet printer comprising a body and a reservoir cover according to claim 1.

5. The reservoir cover according to claim 1, wherein the at least one $1^{st}$ liquid connector comprises a plurality of $1^{st}$ liquid connectors, each capable of being positioned removably relative to the upper surface of the cover, at different positions on this upper surface, and each comprising at least one inner conduit to bring at least one liquid to an inlet of said through conduit, that passes through at least part of the cover, and wherein the means for maintaining said $1^{st}$ liquid connector fixed relative to the cover, in one of said positions, comprises means for maintaining said plurality of $1^{st}$ liquid connectors fixed relative to the cover, each in one of said positions.

6. A reservoir cover for a continuous inkjet printer, the cover comprising:

an upper surface;

a lower surface;

an upper part and a lower part of the cover between the upper surface and lower surface, at least said lower part of the cover being delimited laterally by a peripheral surface;

at least one through conduit that passes through at least part of the cover to bring at least one liquid from said upper part to said lower part, at least one $1^{st}$ liquid connector, adapted to be positioned removably relative to the upper surface of the cover, at different positions on this upper surface, said $1^{st}$ liquid connector comprising at least one inner conduit to bring at least one liquid to an inlet of said through conduit, that passes through at least part of the cover;

means for maintaining said $1^{st}$ liquid connector fixed relative to the cover, in one of said positions; and at least one $2^{nd}$ liquid connector, adapted to be removably fixed on the lower surface, to bring at least one liquid from an outlet of said through conduit and to direct at least some of said at least one liquid laterally towards said peripheral surface ($S_e$).

7. The reservoir cover according to claim 6, the lower surface of the cover also comprising one or several patterns, each:

being prolonged by a conduit passing through at least part of the cover to bring at least one liquid from said upper part to said lower part;

or identifying the position of a through conduit to be made, one or several of said plurality of patterns defining one or several positions at which the $2^{nd}$ liquid connector is adapted to be positioned and fixed using means for maintaining said $2^{nd}$ liquid connector fixed relative to the cover.

8. The reservoir cover according to claim 6, said $2^{nd}$ liquid connector comprising at least one conduit and a $1^{st}$ chamber delimited by an internal surface in which said conduit opens up, the $1^{st}$ chamber, when the $2^{nd}$ liquid connector is fixed on the lower surface, also being delimited by said peripheral surface ($S_e$), at least one orifice being provided so that a liquid contained in this chamber can flow in a direction parallel to said peripheral surface.

9. A reservoir comprising a body and a reservoir cover according to claim 8, at least the $1^{st}$ chamber being closed laterally by the inner wall of the reservoir body.

10. The reservoir cover according to claim 6, said $2^{nd}$ liquid connector, that is adapted to be removably fixed on the lower surface, of the cover, comprising:

at least one conduit to bring at least one liquid flow from the outlet of at least one through conduit and to direct at least some of said liquid flow laterally towards said peripheral surface ($S_e$);

or at least 2 conduits, at least partly parallel to each other.

11. The reservoir according to claim 1, also comprising a hydraulic circuit for drawing off liquid from part of the reservoir and for circulating said liquid to at least one 1st liquid connector, when it is fixed removably on the upper surface, to bring at least part of said liquid to an inlet of a through conduit.

12. An inkjet printer comprising a print head, a reservoir according to claim 1, at least one ink reservoir supply circuit, at least one solvent reservoir supply circuit, at least one circuit to supply ink to the print head, at least one circuit to return unused ink from the print head.

13. The inkjet printer according to claim 12, at least one of the circuits among the ink reservoir supply circuit and the ink return circuit being connected to at least a $1^{st}$ liquid connector, fixed removably on the upper surface of the cover.

14. A reservoir cover for a continuous inkjet printer, the cover comprising:

an upper surface;

a lower surface;

an upper part and a lower part of the cover between the upper surface and lower surface, at least said lower part of the cover being delimited laterally by a peripheral surface;

at least one through conduit that passes through at least part of the cover to bring at least one liquid from said upper part to said lower part, at least one $1^{st}$ liquid connector, adapted to be positioned removably relative to the upper surface of the cover, at different positions on this upper surface, said $1^{st}$ liquid connector comprising at least one inner conduit to bring at least one liquid to an inlet of said through conduit, that passes through at least part of the cover; and at least one of a screw or a quarter turn fastener or one or more clamp collar or one or more clips nut for maintaining said $1^{st}$ liquid connector fixed relative to the cover, in one of said positions, wherein the upper surface of the cover comprises one or several patterns, each being prolonged by a conduit passing through at least part of the cover to bring a liquid in from said upper part to said lower part or identifying the position of a through conduit to be made, one or several of said plurality of patterns defining one or several positions at which the $1^{st}$ liquid connector is adapted to be positioned and fixed using at least one of a screw or a quarter turn fastener or one or more clamp collar or one or more clips nut for maintaining said $1^{st}$ liquid connector fixed relative to the cover.

15. The reservoir cover according to claim 14, comprising a plurality of through conduits, each passing through at least part of the cover to bring a liquid from said upper part to said lower part of the cover.

16. The reservoir cover according to claim 14, wherein the at least one $1^{st}$ liquid connector comprises a plurality of $1^{st}$ liquid connectors, each capable of being positioned removably relative to the upper surface of the cover, at different positions on this upper surface, and each comprising at least one inner conduit to bring at least one liquid to an inlet of said through conduit, that passes through at least part of the cover, and wherein the at least one of a screw or a quarter turn fastener or one or more clamp collar or one or more clips nut comprises a plurality of screws or a plurality of quarter turn fasteners or a plurality of clamp collars or a plurality of clips nuts for maintaining said plurality of $1^{st}$ liquid connectors fixed relative to the cover, each in one of said positions, respectively.

17. A reservoir cover for a continuous inkjet printer, the cover comprising:

an upper surface;

a lower surface;

an upper part and a lower part of the cover between the upper surface and lower surface, at least said lower part of the cover being delimited laterally by a peripheral surface;

at least one through conduit that passes through at least part of the cover to bring at least one liquid from said upper part to said lower part, at least one $1^{st}$ liquid connector, adapted to be positioned removably relative to the upper surface of the cover, at different positions on this upper surface, said $1^{st}$ liquid connector comprising at least one inner conduit to bring at least one liquid to an inlet of said through conduit, that passes through at least part of the cover;

at least one of a screw or a quarter turn fastener or one or more clamp collar or one or more clips nut for maintaining said $1^{st}$ liquid connector fixed relative to the cover, in one of said positions; and at least one $2^{nd}$ liquid connector, adapted to be removably fixed on the lower surface, to bring at least one liquid from an outlet of said through conduit and to direct at least some of said at least one liquid laterally towards said peripheral surface ($S_e$).

18. The reservoir cover according to claim 17, the lower surface of the cover also comprising one or several patterns, each:

being prolonged by a conduit passing through at least part of the cover to bring at least one liquid from said upper part to said lower part;

or identifying the position of a through conduit to be made, one or several of said plurality of patterns defining one or several positions at which the $2^{nd}$ liquid connector is adapted to be positioned and fixed using at least one of a screw or a quarter turn fastener or one or more clamp collar or one or more clips nut for maintaining said $2^{nd}$ liquid connector fixed relative to the cover.

19. The reservoir cover according to claim 17, said $2^{nd}$ liquid connector comprising at least one conduit and a $1^{st}$ chamber delimited by an internal surface in which said conduit opens up, the $1^{st}$ chamber, when the $2^{nd}$ liquid connector is fixed on the lower surface, also being delimited by said peripheral surface ($S_e$), at least one orifice being provided so that a liquid contained in this chamber can flow in a direction parallel to said peripheral surface.

20. The reservoir cover according to claim 17, said $2^{nd}$ liquid connector, that is adapted to be removably fixed on the lower surface, of the cover, comprising:

at least one conduit to bring at least one liquid flow from the outlet of at least one through conduit and to direct at least some of said liquid flow laterally towards said peripheral surface ($S_e$);

or at least two conduits, at least partly parallel to each other, each to bring at least one liquid flow from the outlet of at least one through conduit and to direct at least some of said liquid flow laterally towards said peripheral surface ($S_e$).

* * * * *